US008172472B2

(12) United States Patent
Tani

(10) Patent No.: US 8,172,472 B2
(45) Date of Patent: May 8, 2012

(54) STICK-SHAPED MATERIAL EXTRUDING CONTAINER

(75) Inventor: Yoshikazu Tani, Tokyo (JP)

(73) Assignee: Tokiwa Corporation, Gifu (JP)

( * ) Notice: Subject to any disclaimer, the term of this patent is extended or adjusted under 35 U.S.C. 154(b) by 1210 days.

(21) Appl. No.: 11/979,757

(22) Filed: Nov. 8, 2007

(65) Prior Publication Data

US 2009/0123213 A1 May 14, 2009

(51) Int. Cl.
*B43K 21/08* (2006.01)

(52) U.S. Cl. ..... 401/78; 401/75; 401/74; 222/390

(58) Field of Classification Search ..... 401/68, 401/73, 74, 75, 77, 78, 84; 222/386, 390
See application file for complete search history.

(56) References Cited

U.S. PATENT DOCUMENTS 3,677,654 A * 7/1972 Davis ..... 401/63
4,781,483 A * 11/1988 Lorscheidt ..... 401/55
5,839,622 A * 11/1998 Bicknell et al. ..... 222/390
6,343,886 B2 * 2/2002 Shochat ..... 401/87

* cited by examiner

*Primary Examiner* — David Walczak
(74) *Attorney, Agent, or Firm* — Bacon & Thomas, PLLC

(57) ABSTRACT

To perform forward and backward movements of a stick-shaped material without trouble and prevent detachment of the stick-shaped material by an impact, a piston (7) in a movable body (6) arranged within a container (100) is closely attached within a filling member (1), the stick-shaped material (M) is loaded in the filling member (1) so as to be closely attached thereto, and the piston (7) is closely attached to the stick-shaped material (M), whereby the stick-shaped material (M) is pushed by a forward movement of the piston (7) to appear from an opening (1*a*) of the container, a sucking action generated due to decompression is applied between the piston (7) and the stick-shaped material (M) by a backward movement of the piston (7) to retract the stick-shaped material (M), and the decompression prevents falling off of the stick-shaped material (M) from the container (100).

6 Claims, 33 Drawing Sheets

STICK-SHAPED MATERIAL EXTRUDING CONTAINER

BACKGROUND OF THE INVENTION

1. Field of the Invention

The present invention relates to a stick-shaped material extruding container for extruding a stick-shaped material so as to use.

2. Description of the Conventional Art

Conventionally, as a stick-shaped cosmetic material container, there has been known a structure which is provided with a cylindrical sleeve open in both ends, a cylindrical operating portion coupling the sleeve so as to be relatively rotatable and immovable in an axial direction, a cylindrical middle plate installed to a rear half portion within the sleeve so as to be non-rotatable and movable in the axial direction, and a stick-shaped cosmetic material loaded directly to a sleeve to which the middle plate is installed and in which a lid is installed to a leading end from a rear end side of the sleeve so as to be molded, and in which if the sleeve and the operating portion are relatively rotated, the middle plate moves forward and backward with respect to the sleeve and the stick-shaped cosmetic material appears and retracts from the leading end of the sleeve (for example, refer to Japanese Unexamined Patent Publication No. 2001-87033).

SUMMARY OF THE INVENTION

Problem to be Solved by the Invention

However, in the stick-shaped cosmetic material container having the structure mentioned above, if an impact, a vibration or the like is applied, for example, by letting the container drop or the like, there is a problem that the stick-shaped cosmetic material breaks away from the middle plate so as to throw off from the container.

The present invention is made for the purpose of solving the problem mentioned above, and an object of the present invention is to provide a stick-shaped material extruding container which can prevent a stick-shaped material from falling off from the container in the case that an impact, a vibration or the like is applied and an external action is added, as well as it is possible to feed out and feed back a stick-shaped material including the stick-shaped cosmetic material.

Means for Solving the Problem

In accordance with the present invention, there is provided a stick-shaped material extruding container comprising:

a tubular filling member installed to the container and having both ends open; and a stick-shaped material loaded to the filling member, in which, when a container front portion and a container rear portion which is relatively rotatable with respect to the container front portion are relatively rotated in one direction, a movable body arranged within the container moves forward so as to make the stick-shaped material appear from an opening portion at a leading end of the container, and when the container front portion and the container rear portion are relatively rotated in the other direction corresponding to an opposite direction to the one direction, the movable body moves rearward, wherein a piston-like extruding portion is provided within the container, the piston-like extruding portion being positioned at a leading end of the movable body and closely attached into the filling member so as to be slidable, wherein the stick-shaped material is loaded within the filling member so as to be closely attached, and wherein the movable body is moved backward, whereby a sucking action is applied on the basis of the backward movement of the extruding portion and the stick-shaped material is pulled back within the filling member, while the extruding portion and the stick-shaped material maintain the closely attached state within the filling member.

In accordance with the stick-shaped material extruding container mentioned above, since the extruding portion is positioned at the leading end of the movable body which is arranged within the container and is moved forward and backward, the extruding portion is closely attached within the filling member, the stick-shaped material loaded to the filling member is closely attached within the filling member, and the extruding portion is structured in the piston shape, so as to be closely attached to the stick-shaped material within the filling member, the stick-shaped material is extruded in accordance with the forward movement of the extruding portion so as to appear from the opening portion at the leading end of the container, and the sucking action (the action for maintaining the close attachment) caused by decompression is applied between the extruding portion and the stick-shaped material in accordance with the backward movement of the extruding portion, whereby the stick-shaped material is pulled back within the filing member. Accordingly, it is possible to feed out and feedback the stick-shaped material without trouble. Further, in the case that the impact, the vibration or the like is applied and the external action is added, a decompression state is formed between the extruding portion and the stick-shaped material if they are going to separate from each other and the closely attaching action is applied. Therefore, the stick-shaped material does not separate from the extruding portion, and it is possible to prevent the stick-shaped material from falling off from the container. Further, since the stick-shaped material (for example, a particularly soft material (for example, a jelly-like material or a mousse-like material which can not be molded like as a ordinary stick-shaped material) is closely attached within the filling member as mentioned above, a broken portion does not break away from the filling member and can be continuously used, even if the stick-shaped material is broken within the filling member.

Meanwhile, in the container described in Japanese Unexamined Patent Publication No. 2001-87033 mentioned above, since the rear end surface of the stick-shaped cosmetic material is open to the rear side via the cylindrical middle plate, the closely attaching action due to decompression is not applied to the portion between the stick-shaped cosmetic material and the middle plate in the case that the impact, the vibration or the like is applied and the external action is added. Accordingly, there is a case that the stick-shaped cosmetic material easily breaks away from the middle plate.

In addition, the structure is preferably made such that the movable body is moved forward when the container front portion and the container rear portion are relatively rotated in one direction, and the movable body moved forward to an optional position is moved backward at a fixed amount and then stops when the container front portion and the container rear portion are relatively rotated in the other direction. In the case of employing the structure mentioned above, if the container front portion and the container rear portion are relatively rotated in the other direction, the movable body moved forward to the optional position is moved backward at the fixed amount and stops. In other words, since the movable body is not moved backward over the fixed amount, it is possible to prevent the movable body from being returned too much, it is possible to prevent the stick-shaped material from not quickly appearing from the opening portion at the next using time and it is possible to improve usability (easiness of use).

Further, the structure is preferably made such that a first engagement portion and a second engagement portion are provided within the container, engaging actions of the first engagement portion and the second engagement portion work together and the movable body is moved forward when the container front portion and the container rear portion are relatively rotated in one direction, the engagement of the first engagement portion is cancelled when the engaging action of the first engagement portion works at a predetermined amount, and only the engaging action of the second engagement portion works and the movable body is moved forward when they are relatively rotated further in one direction. In the case of employing the structure mentioned above, it is possible to secure a length of the stick-shaped material while saving a length in an axial direction of the stick-shaped material extruding container on the basis of a double spiral structure made by the first and second engagement portions. Further, since the movable body can be quickly moved forward on the basis of the synergic action of the first engagement portion and the second engagement portion, and can be slowly moved forward on the basis of the engaging action generated only by the second engagement portion after being moved forward at the predetermined amount, it is possible to prevent the stick-shaped material from erroneously coming out too much.

Further, the structure may be made such that a first engagement portion and a second engagement portion are provided within the container, engaging actions of the first engagement portion and the second engagement portion work together and the movable body is moved backward when the container front portion and the container rear portion are relatively rotated in the other direction, the engagement of the first engagement portion is cancelled when the engaging action of the first engagement portion works at a predetermined amount, and only the engaging action of the second engagement portion works and the movable body is moved backward when they are relatively rotated further in the other direction. In the case of employing the structure mentioned above, it is possible to secure a length of the stick-shaped material while saving a length in an axial direction of the stick-shaped material extruding container on the basis of a double spiral structure made by the first and second engagement portions. Further, since the movable body can be quickly moved backward on the basis of the synergic action of the first engagement portion and the second engagement portion, and can be slowly moved backward on the basis of the engaging action generated only by the second engagement portion after being moved backward at the predetermined amount.

Further, the structure is preferably made such that the stick-shaped material is loaded in the filling member, and the filling member in which the stick-shaped material is loaded is installed to the container. In the case of employing the structure mentioned above, since the stick-shaped material is loaded only in the tubular filling member being open at both ends, the thickness of the filling member is made comparatively uniform the thickness in the diametrical direction of the stick-shaped material is fixed along the axial direction, and it is possible to stabilize the temperature condition after loading a molten stick-shaped material until solidifying the molten stick-shaped material. As a result, it is possible to well load the stick-shaped material and a manufacturing yield ratio can be improved. Further, since the structure is made such as to install the filling member in which the stick-shaped material is loaded, it is easy to manufacture the container.

Further, the structure is preferably made such that the stick-shaped material is loaded in the filling member installed to the container. In the case of employing the structure mentioned above, since the stick-shaped material is loaded only in the tubular filling member being open at both ends in the same manner as mentioned above, it is possible to well load the stick-shaped material and it is possible to improve the manufacturing yield ratio. Further, since the structure is made such that the stick-shaped material is loaded in the filling member installed to the container, it is further easy to manufacture the container.

Further, it is preferable that the filling member is constituted by a transparent raw material. In the case of employing the structure mentioned above, it is possible to check out a state of the stick-shaped material loaded in the filling member from an outer side.

Effect of the Invention

As mentioned above, in accordance with the present invention, it is possible to feed out and feed back the stick-shaped material without trouble, and it is possible to prevent the stick-shaped material from falling off from the container and continuously use the broken stick-shaped material in the case that the impact, the vibration or the like is applied and the external action is added. Further, it is possible to use the stick-shaped material which can not be maintained like as an ordinary stick-shaped material, particularly the soft stick-shaped material.

DETAILED DESCRIPTION OF PREFERRED EMBODIMENTS

Figure 1:
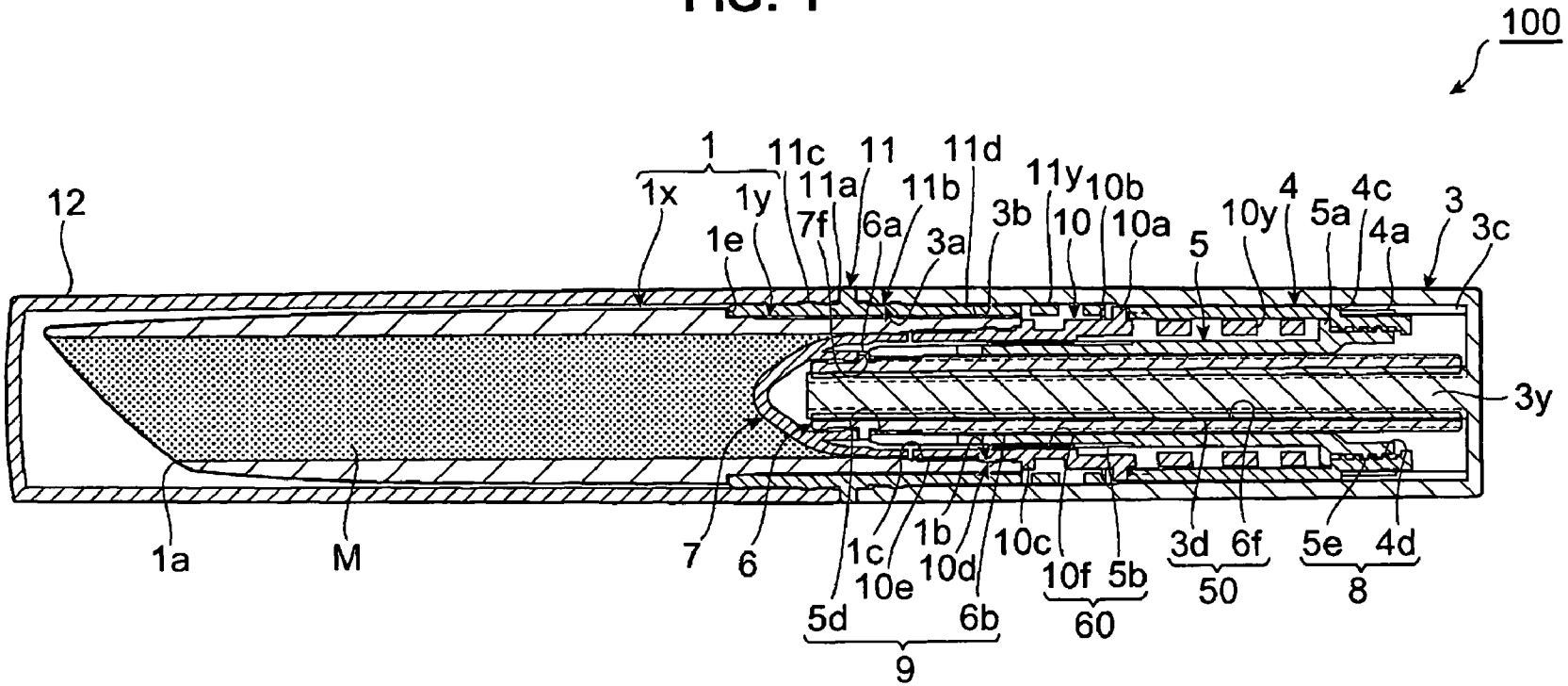
FIG. 1 is a longitudinal sectional view showing an initial state of a stick-shaped material extruding container in accordance with a first embodiment of the present invention.

A description will be given below of preferable embodiments of a stick-shaped material extruding container in accordance with the present invention with reference to FIGS. 1 to 33. In this case, in each of the figures, the same reference numerals are attached to the same elements, and an overlapping description will be omitted.

Figure 18:
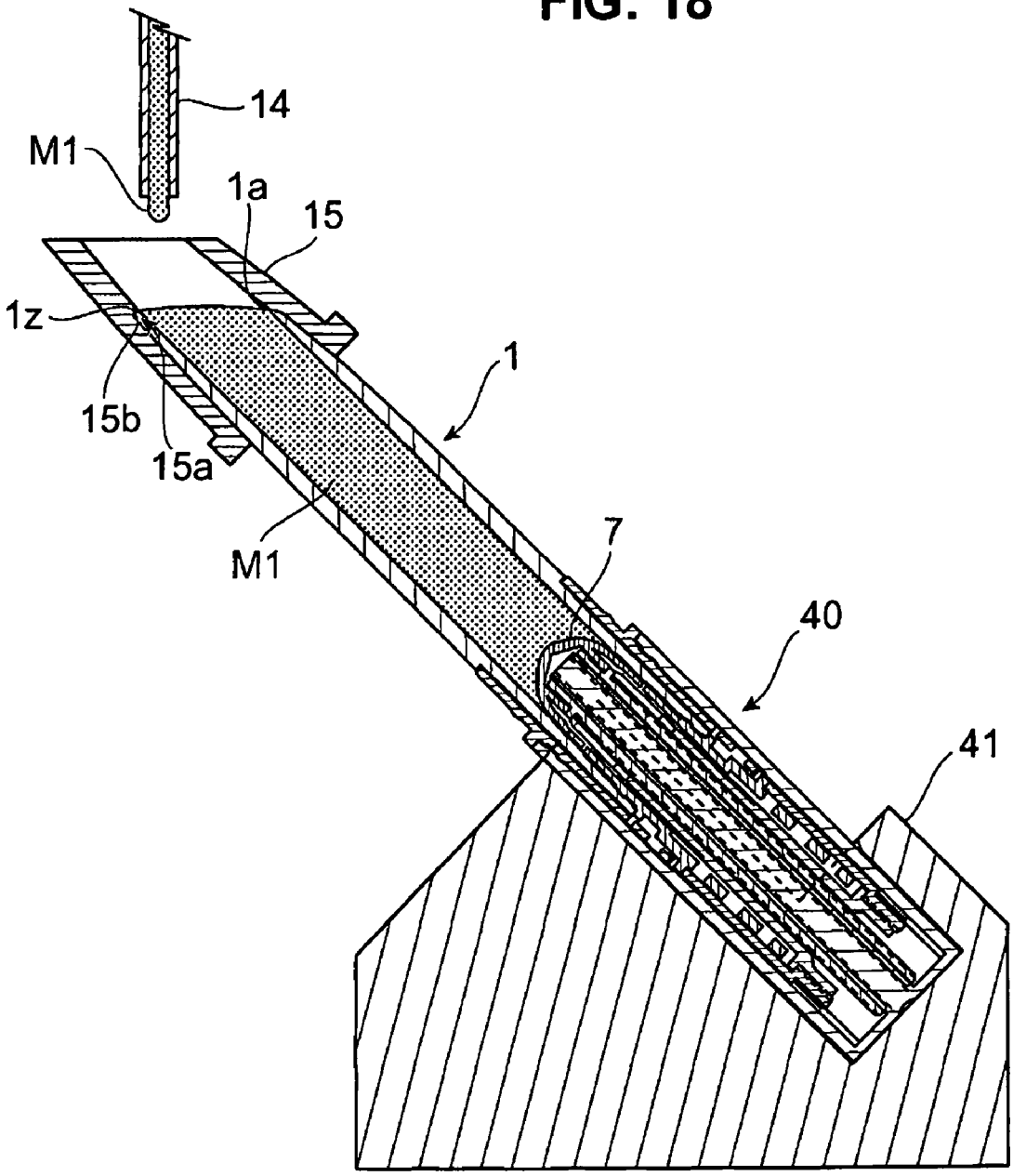
FIG. 18 is an explanatory view showing another manufacturing procedure.
Figure 19:
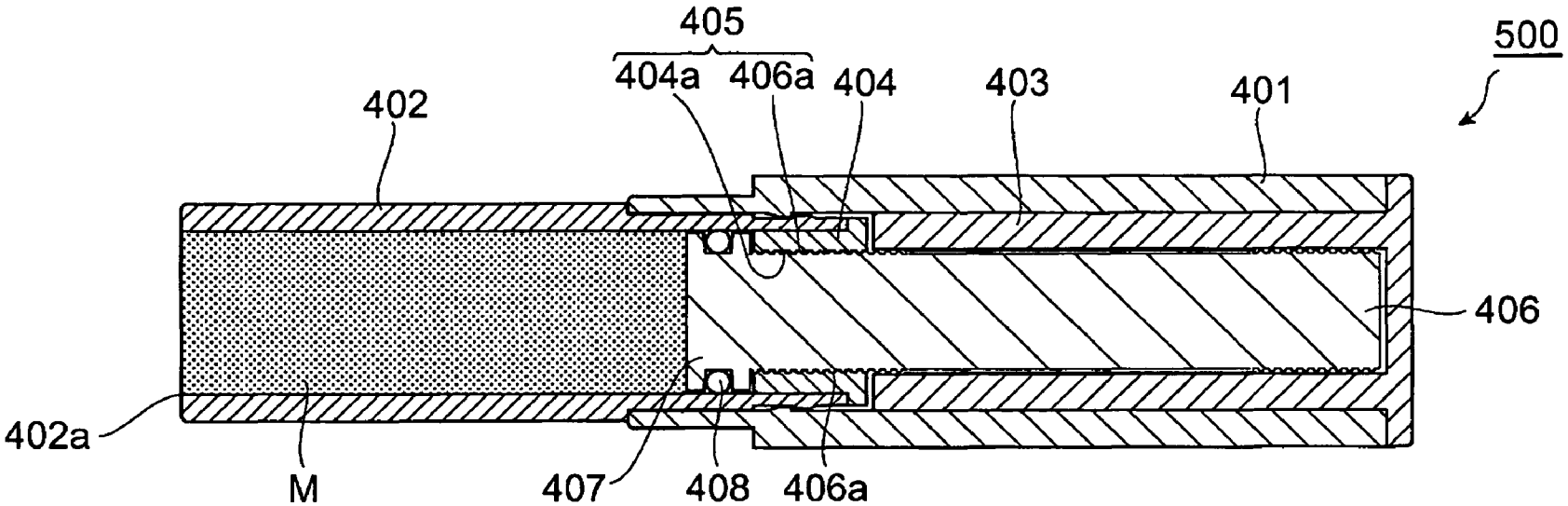
FIG. 19 is a longitudinal sectional view showing a stick-shaped material extruding container in accordance with a second embodiment of the present invention.
Figure 20:
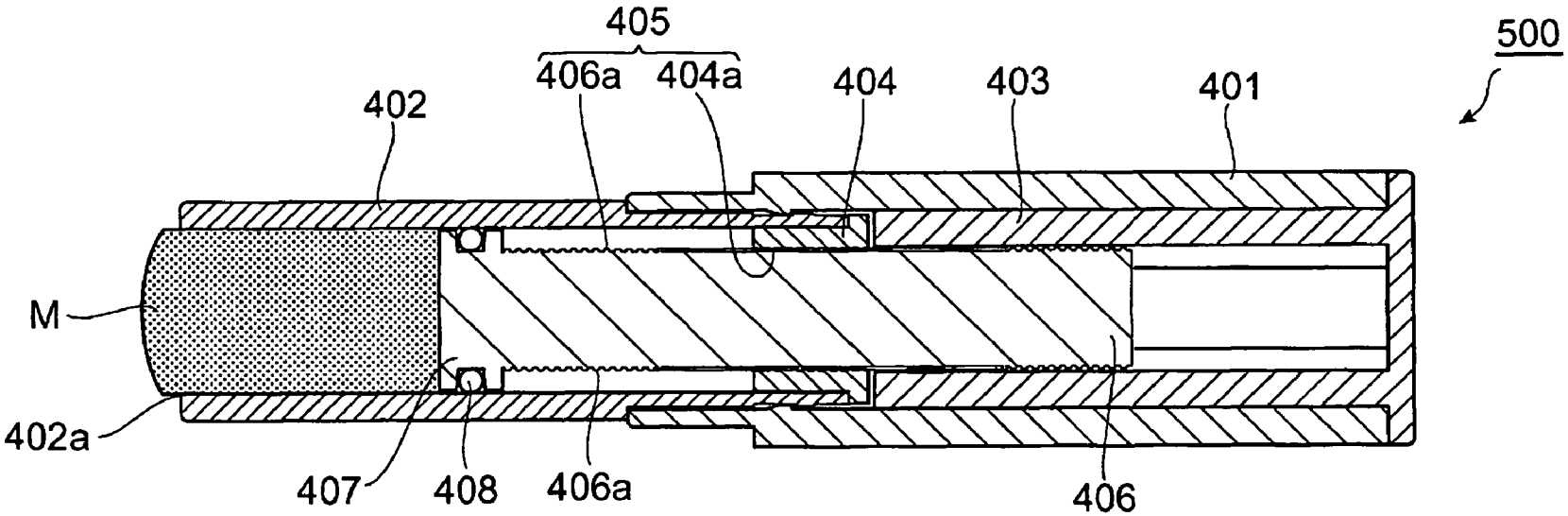
FIG. 20 is a longitudinal sectional view at a time when the movable body is moved forward on the basis of an operation of a user from the state shown in FIG. 19.
Figure 21:
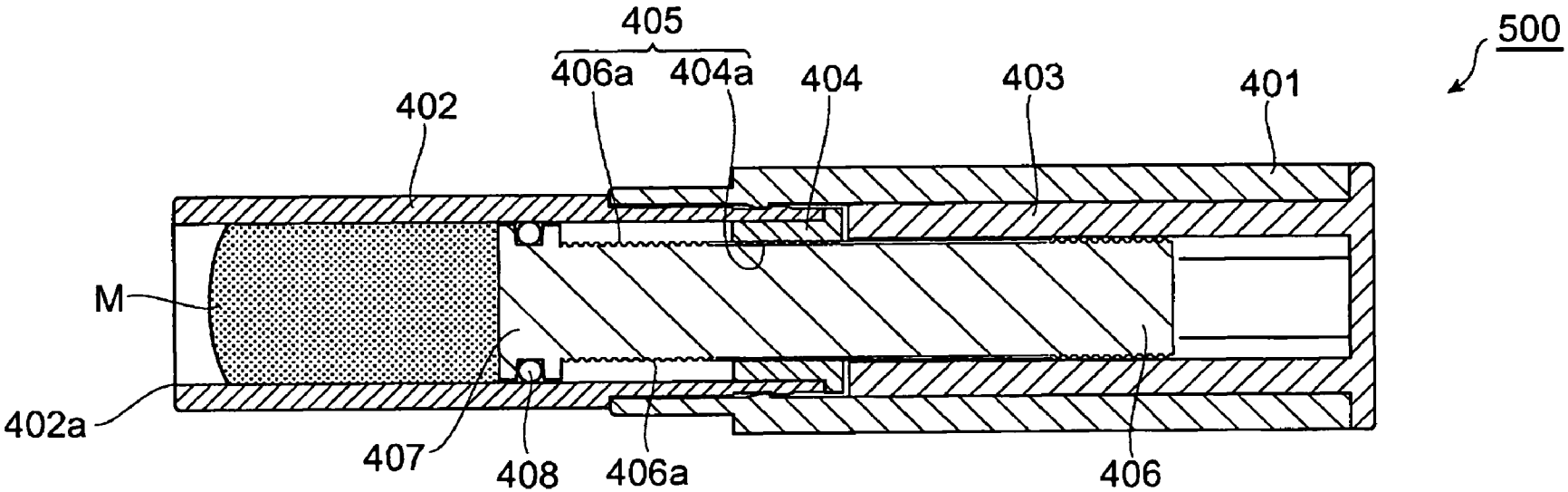
FIG. 21 is a longitudinal sectional view at a time when the movable body is moved backward on the basis of an operation of the user from the state shown in FIG. 20.
Figure 22:
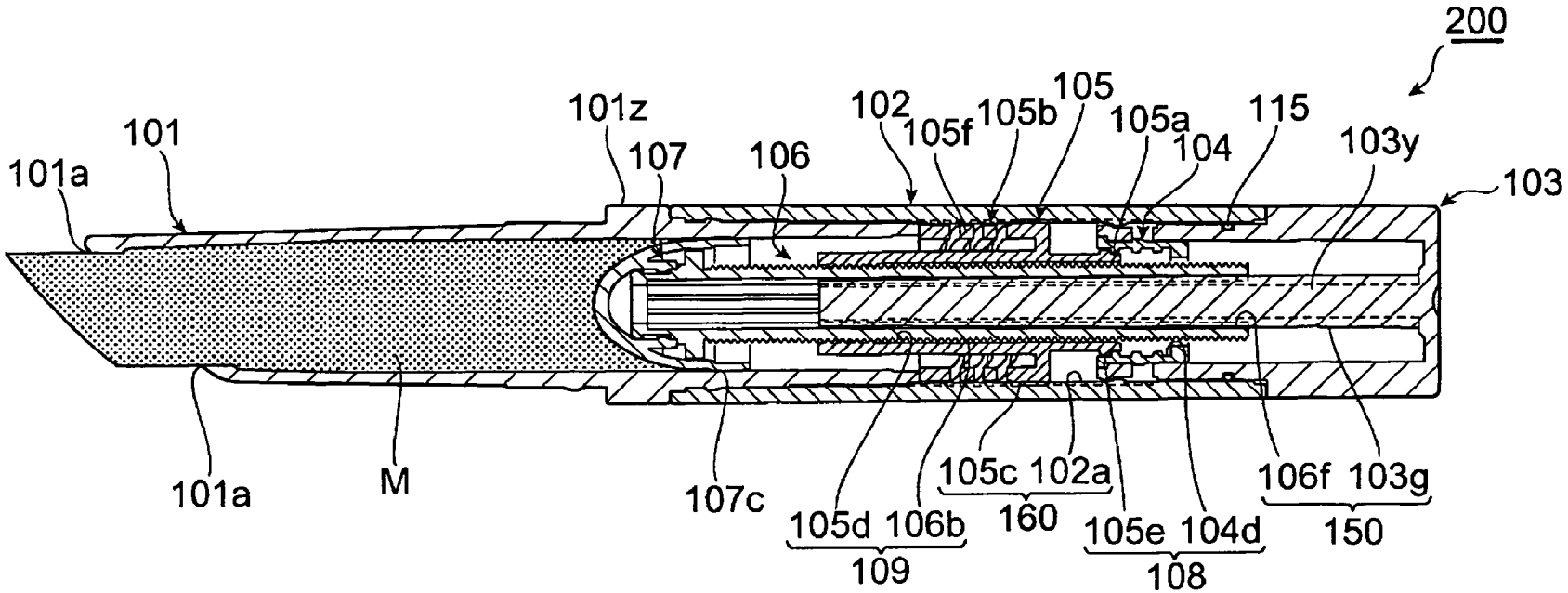
FIG. 22 is a longitudinal sectional view showing a stick-shaped material extruding container in accordance with a third embodiment of the present invention.
Figure 23:
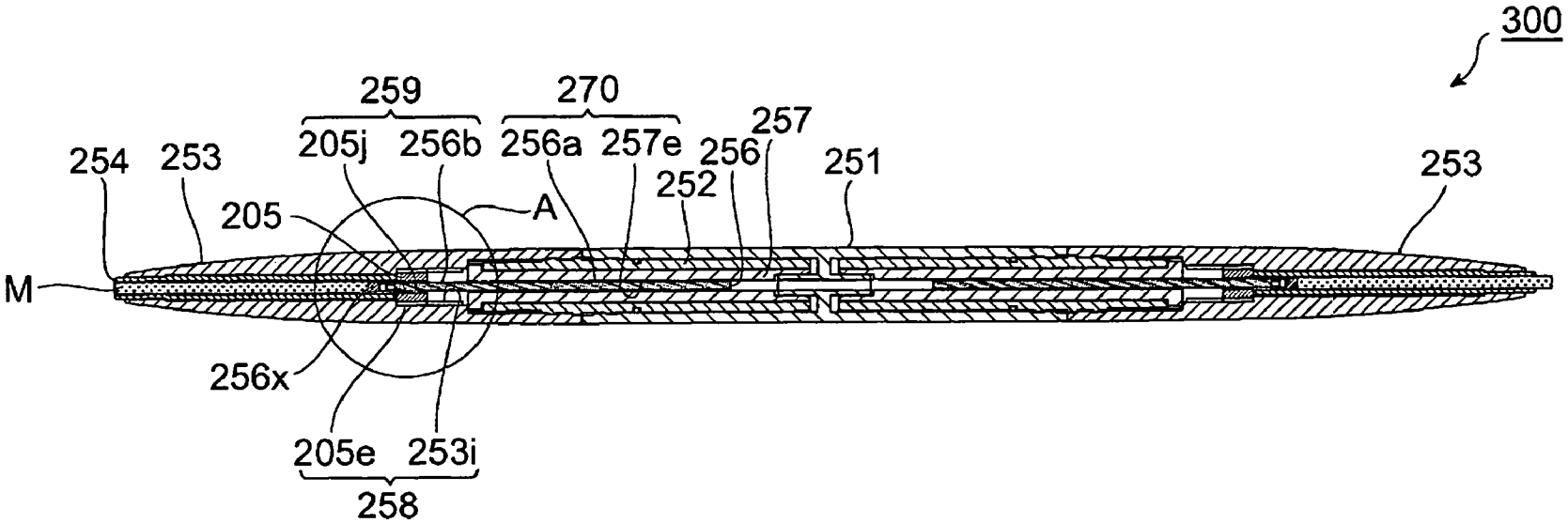
FIG. 23 is a longitudinal sectional view showing a stick-shaped material extruding container in accordance with a fourth embodiment of the present invention.
Figure 24:
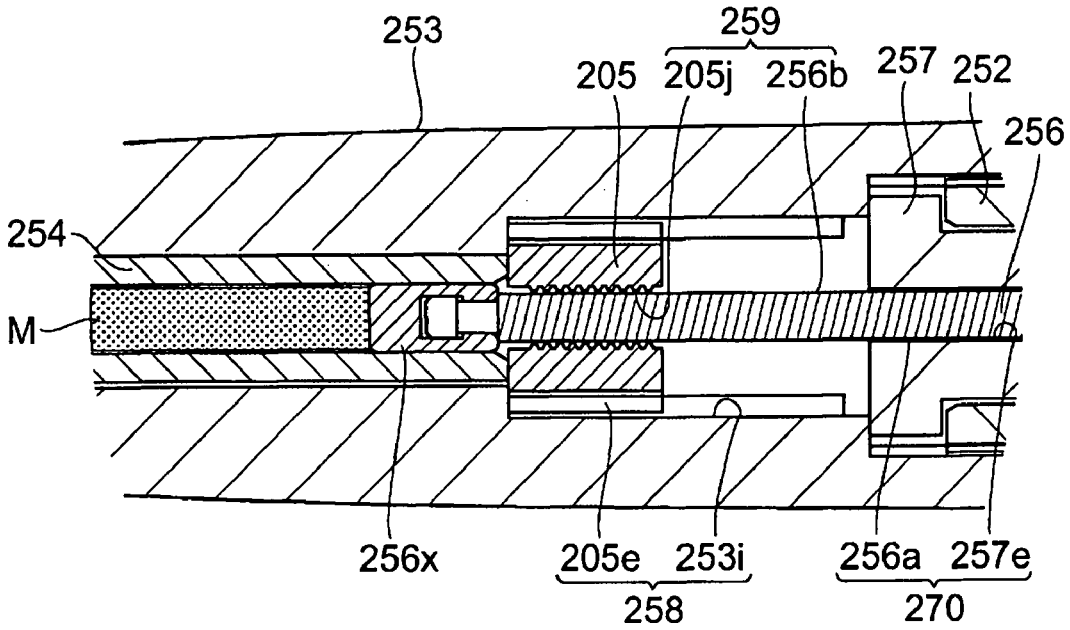
FIG. 24 is an enlarged view of a portion A in FIG. 23.
Figure 25:
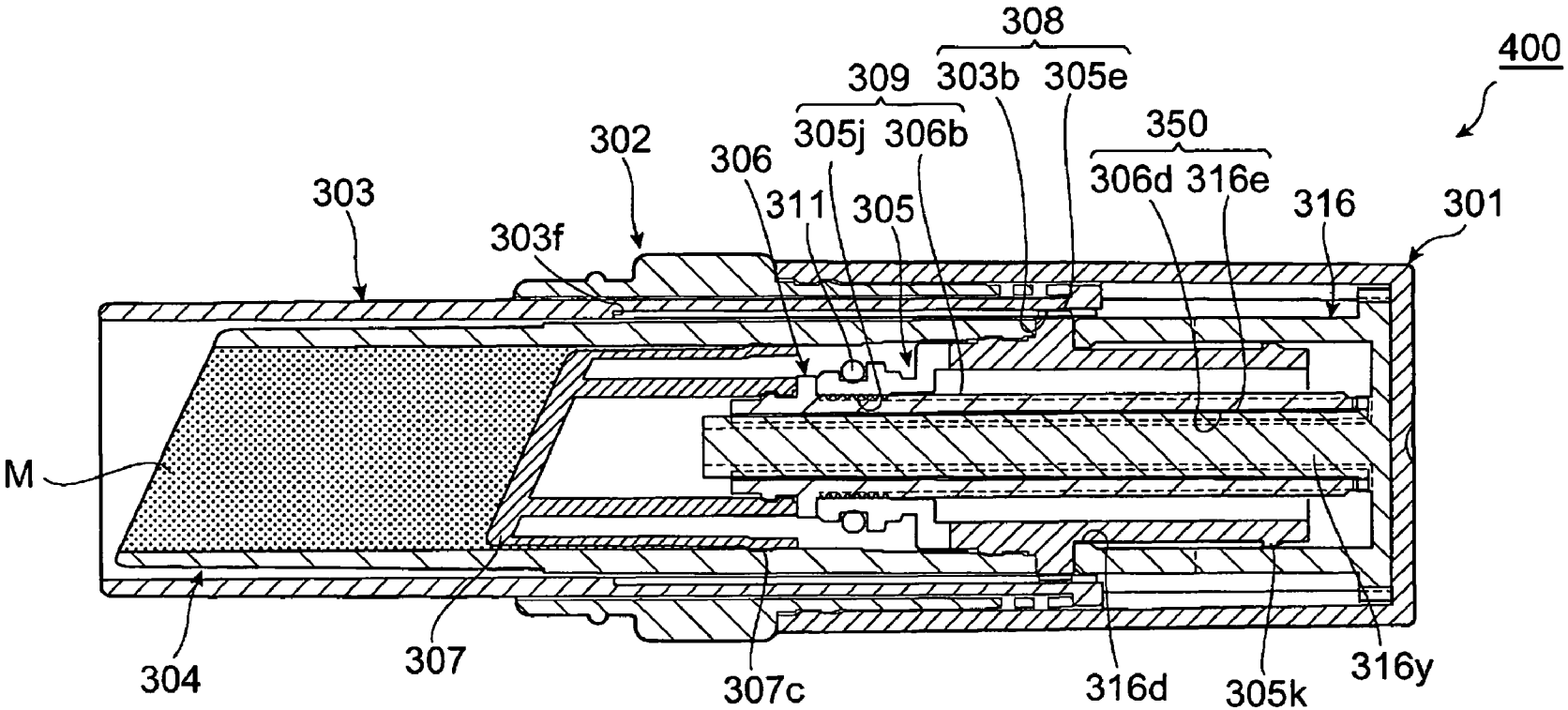
FIG. 25 is a longitudinal sectional view showing an initial state of a stick-shaped material extruding container in accordance with a fifth embodiment of the present invention.
Figure 26:
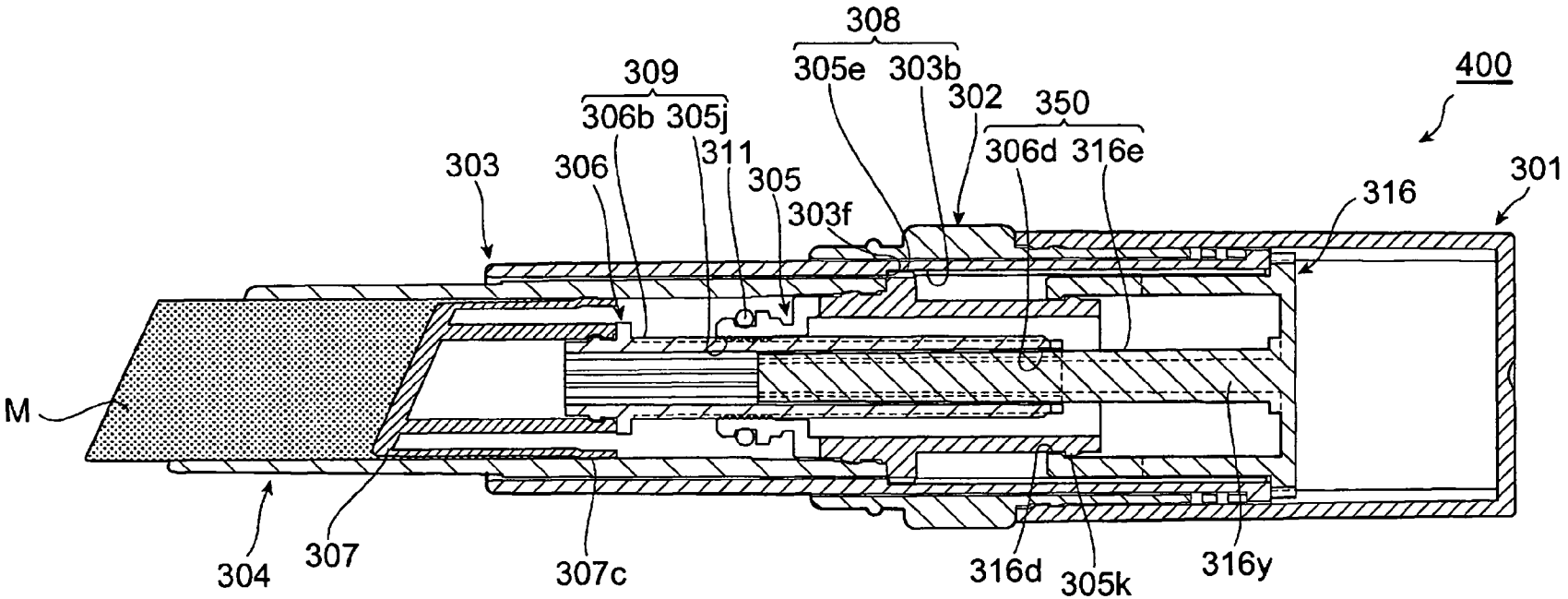
FIG. 26 is a longitudinal sectional view at a time when the movable thread tube and the movable body are moved forward on the basis of an operation of a user from the state shown in FIG. 25.

FIGS. 1 to 18 show a first embodiment in accordance with the present invention, FIGS. 19 to 21 show a second embodiment in accordance with the present invention, FIG. 22 shows a third embodiment in accordance with the present invention, FIGS. 23 and 24 show a fourth embodiment in accordance with the present invention, FIGS. 25 and 26 show a fifth embodiment in accordance with the present invention, and FIGS. 27 to 33 show a sixth embodiment in accordance with the present invention, respectively. A description will be first given of the first embodiment with reference to FIGS. 1 to 18.

Figure 3:
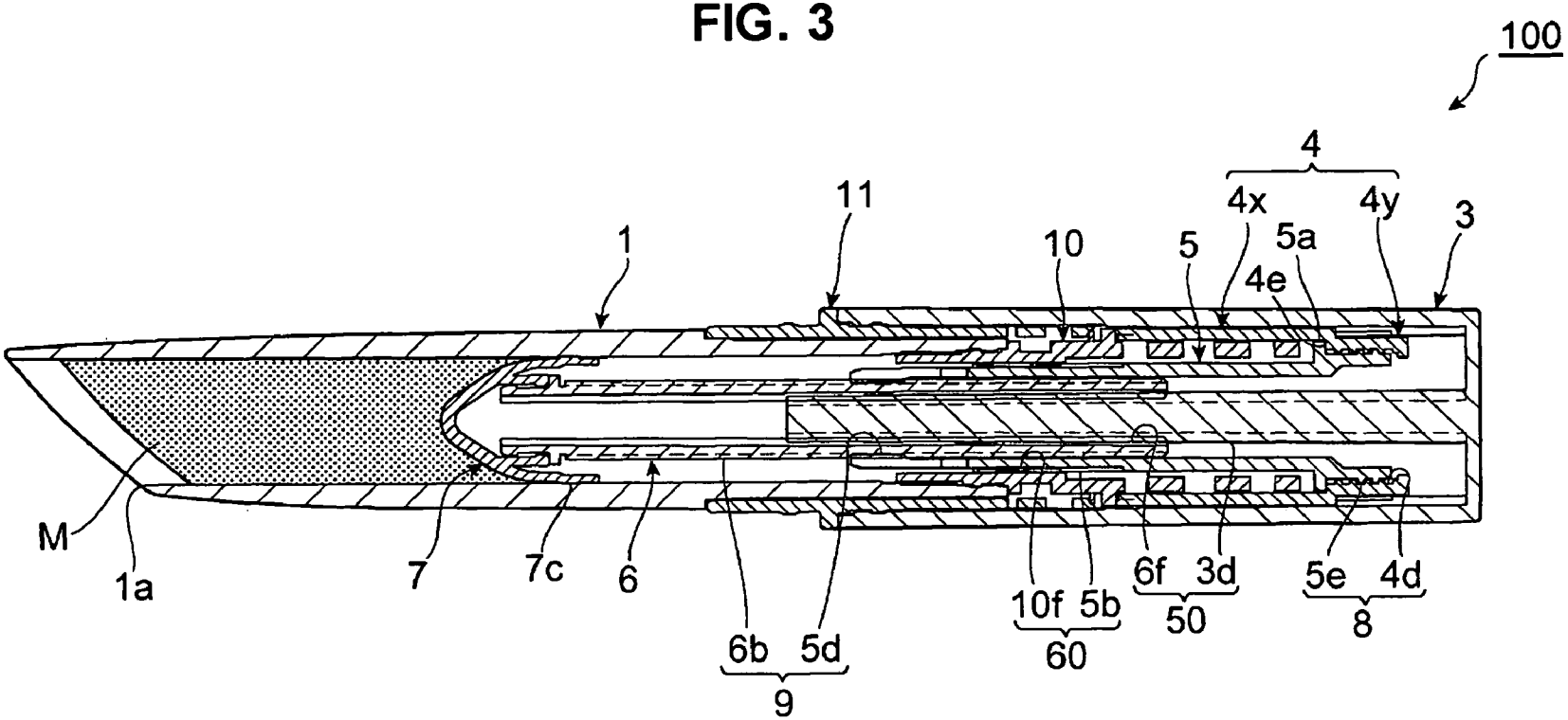
FIG. 3 is a longitudinal sectional view at a time when the movable thread tube and the movable body are moved backward on the basis of an operation of the user after the stick-shaped material is used by the user in a state shown in FIG. 2, and the movable thread tube is moved backward to a backward moving limit.
Figure 4:
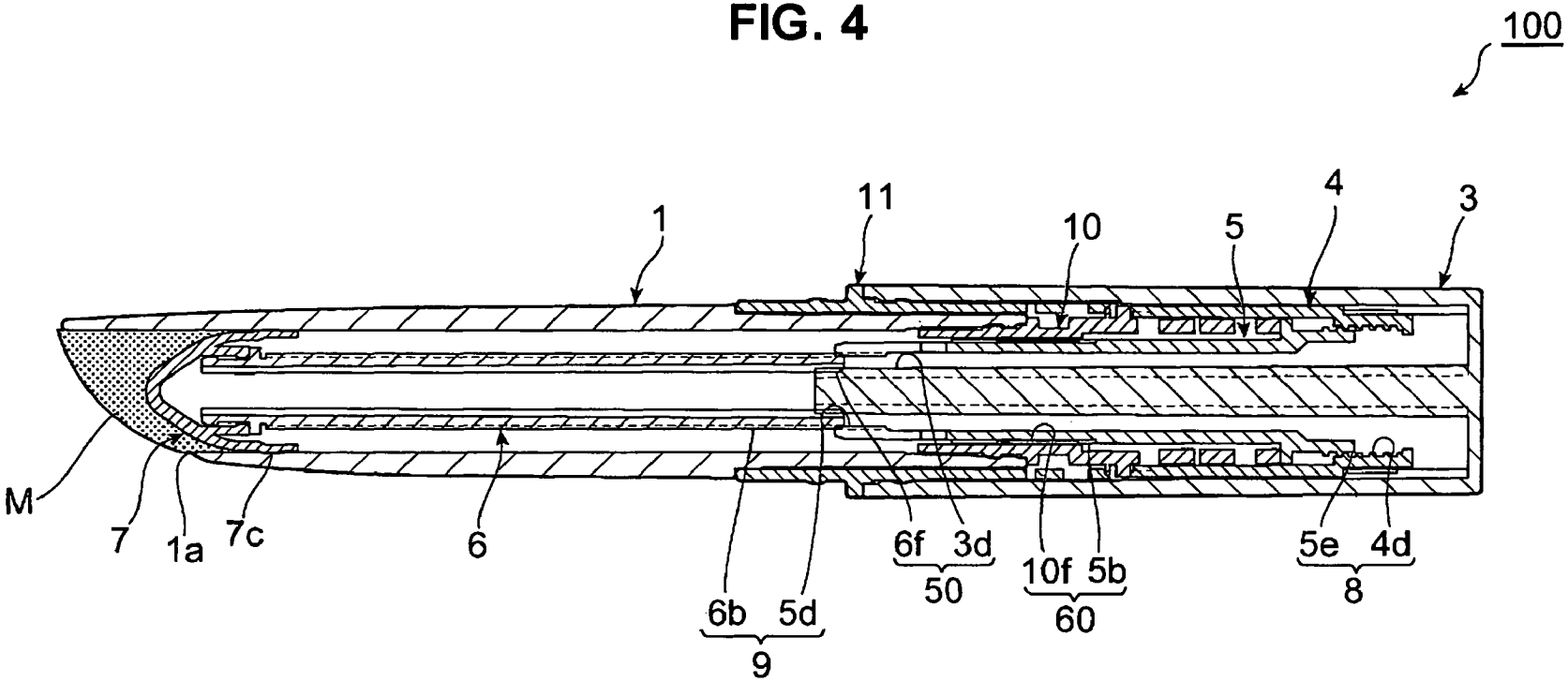
FIG. 4 is a longitudinal sectional view at a time when the movable body is moved forward to the maximum on the basis of an operation of the user from the state shown in FIG. 2.
Figure 5:
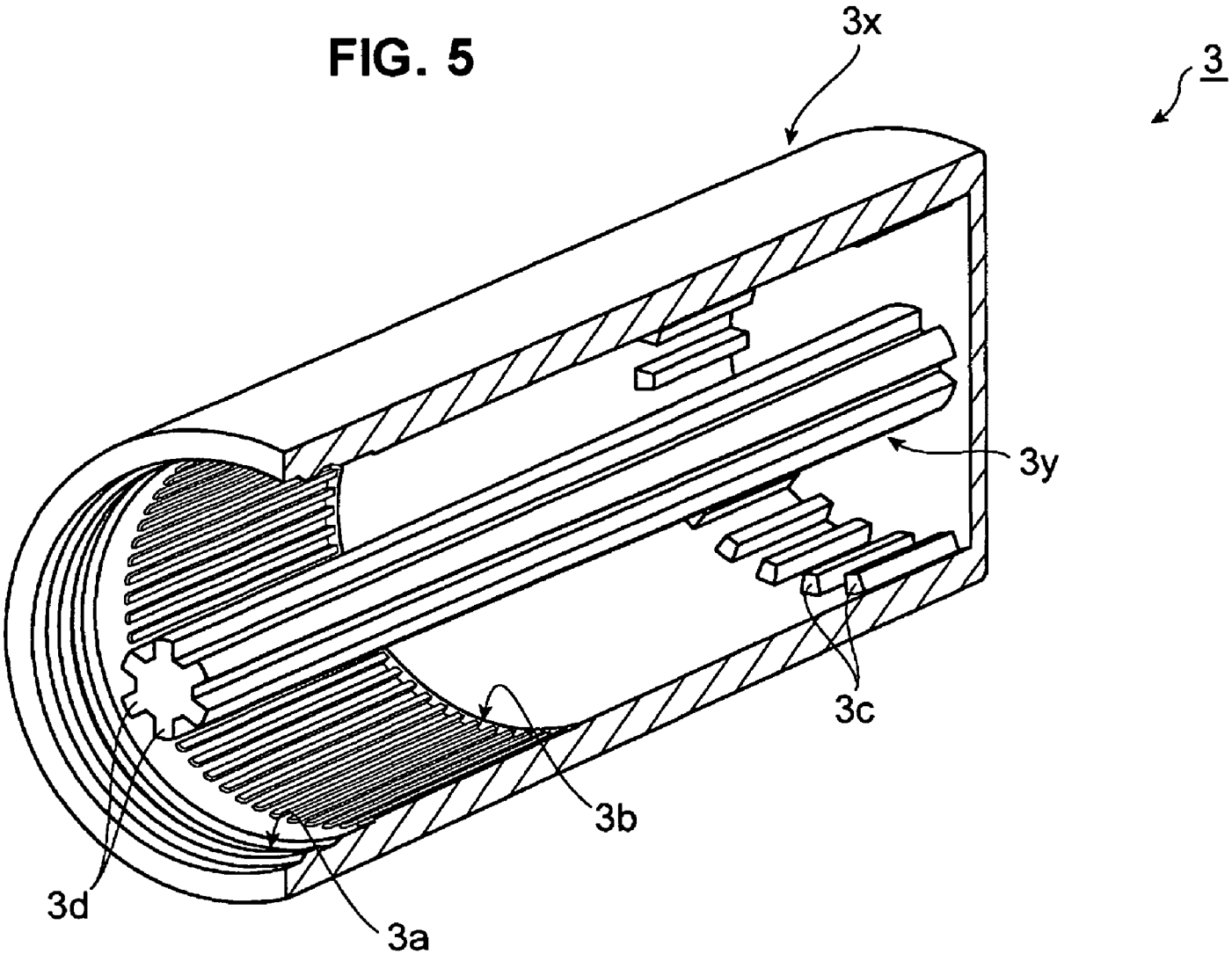
FIG. 5 is a broken perspective view showing a main body tube in FIGS. 1 to 4.
Figure 6:
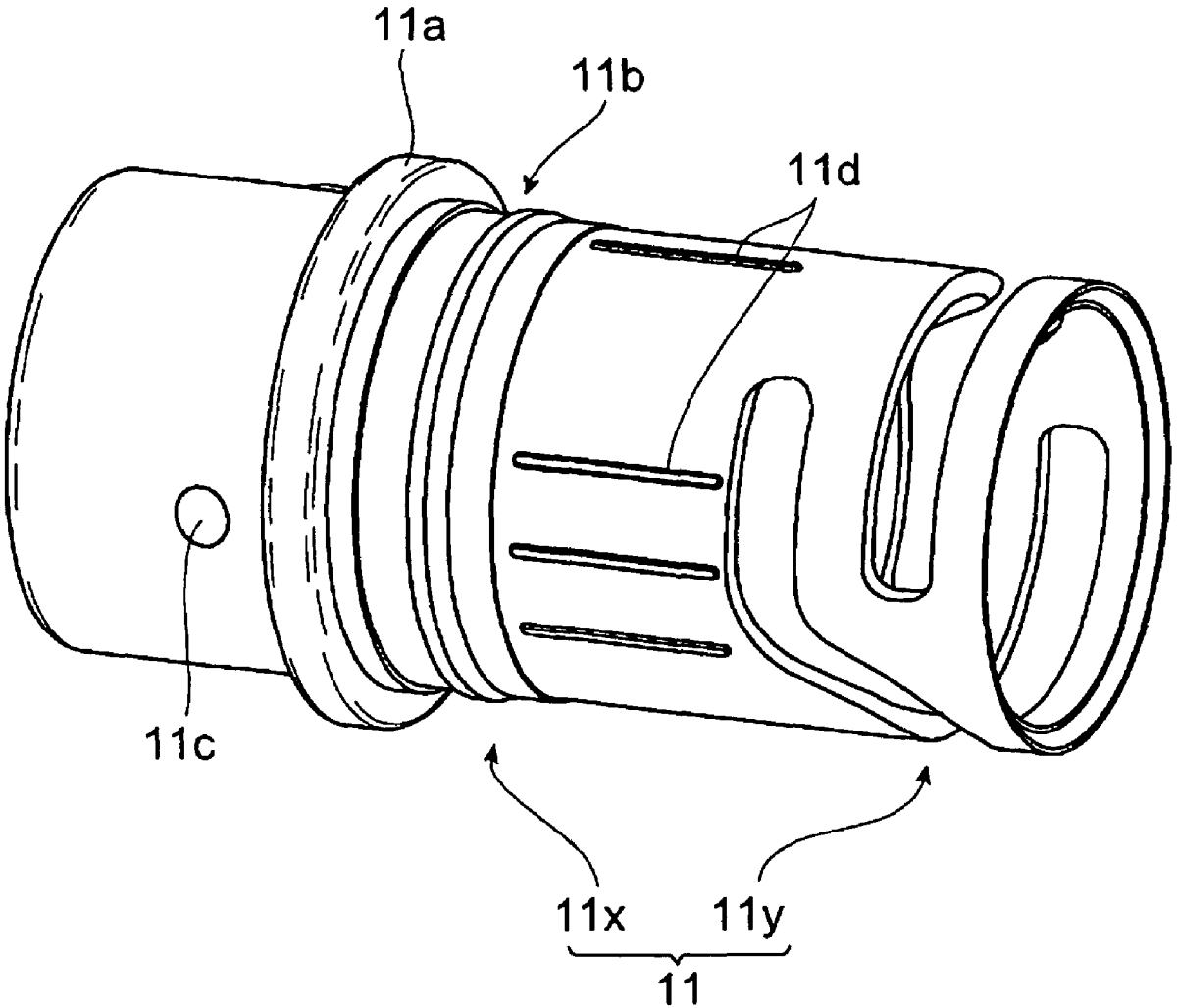
FIG. 6 is a perspective view showing an internal member in FIGS. 1 to 4.
Figure 7:
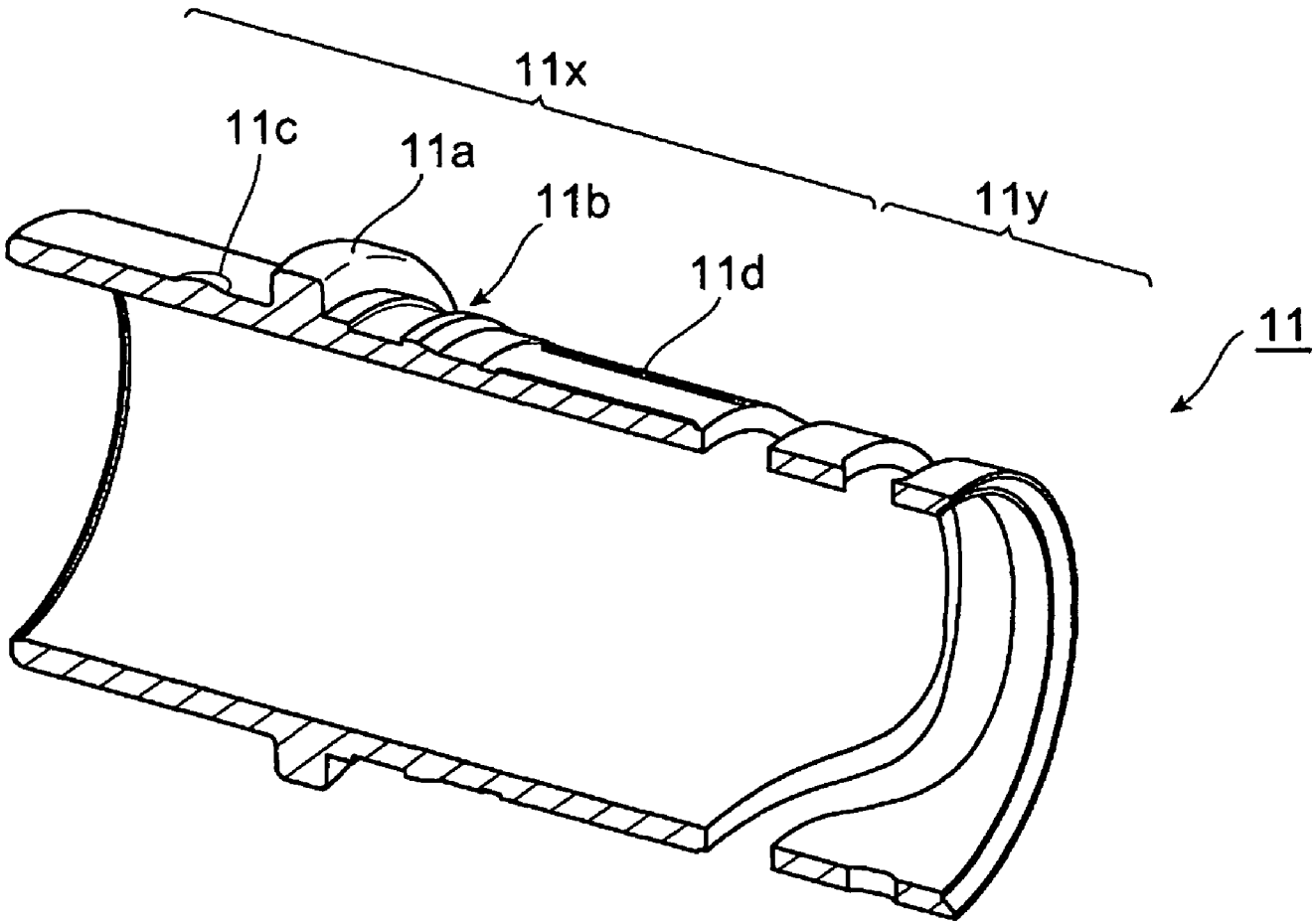
FIG. 7 is a longitudinal sectional perspective view of the internal member shown in FIG. 6.
Figure 8:
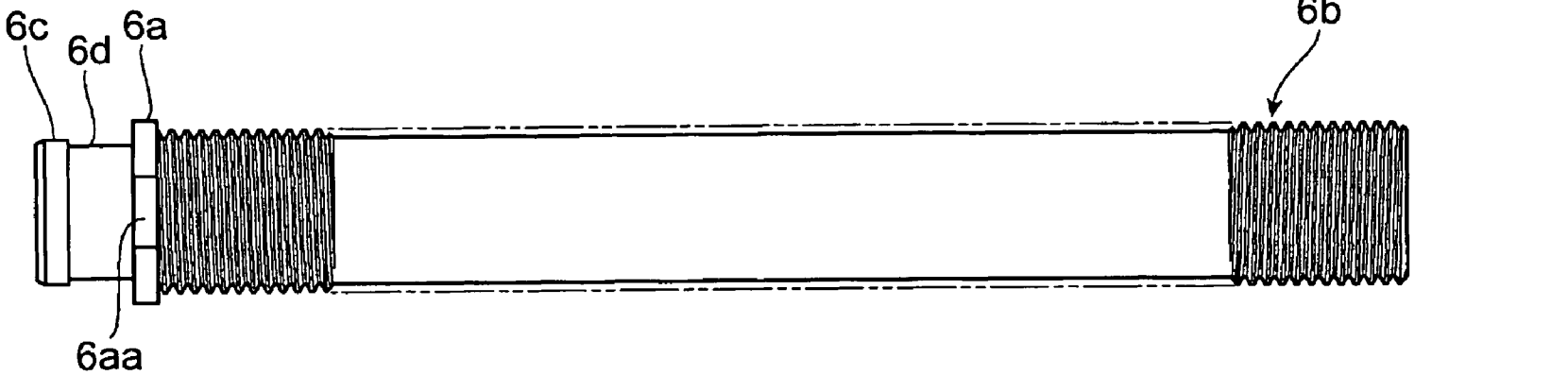
FIG. 8 is a side view showing the movable body in FIGS. 1 to 4.
Figure 9:
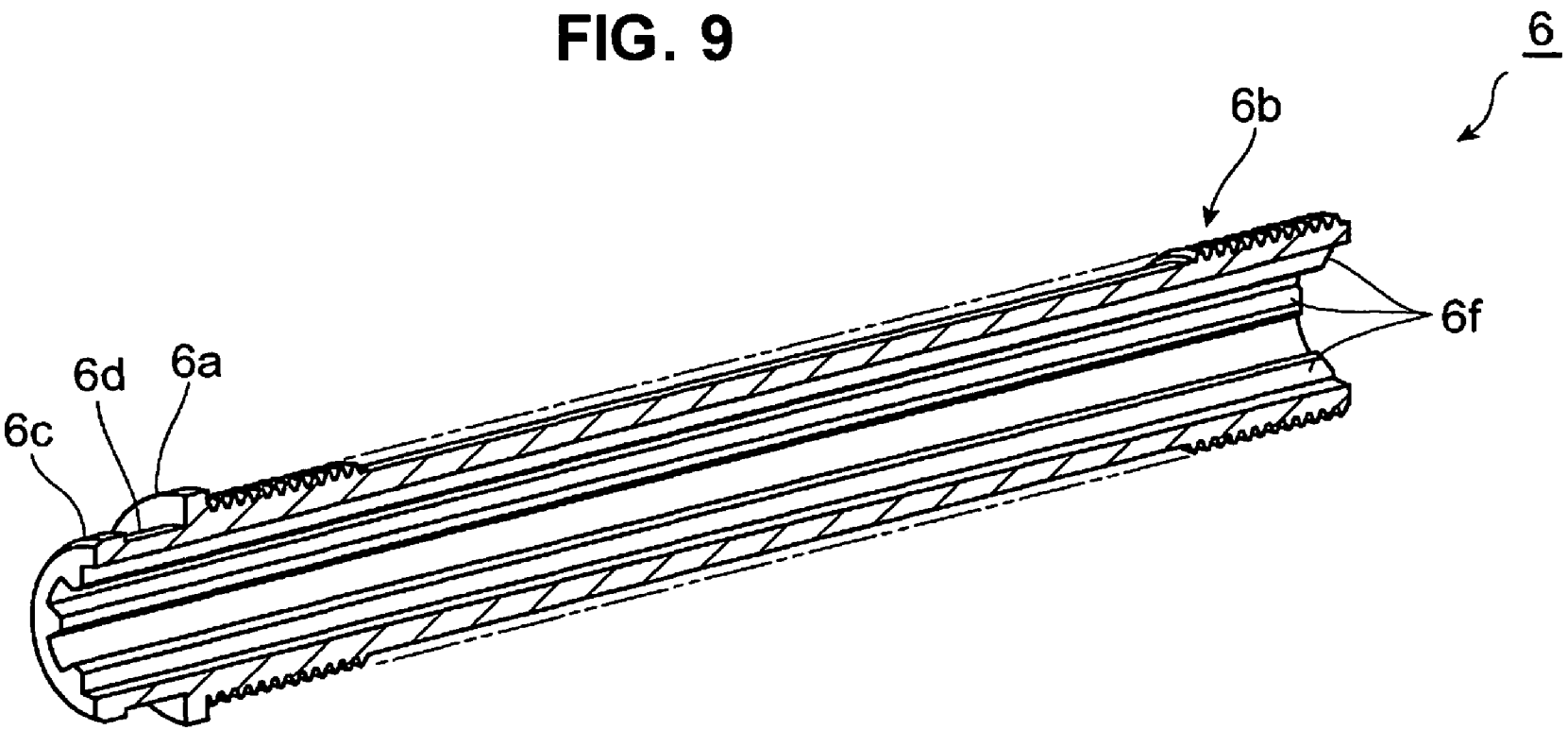
FIG. 9 is a longitudinal sectional perspective view of the movable body shown in FIG. 8.
Figure 10:
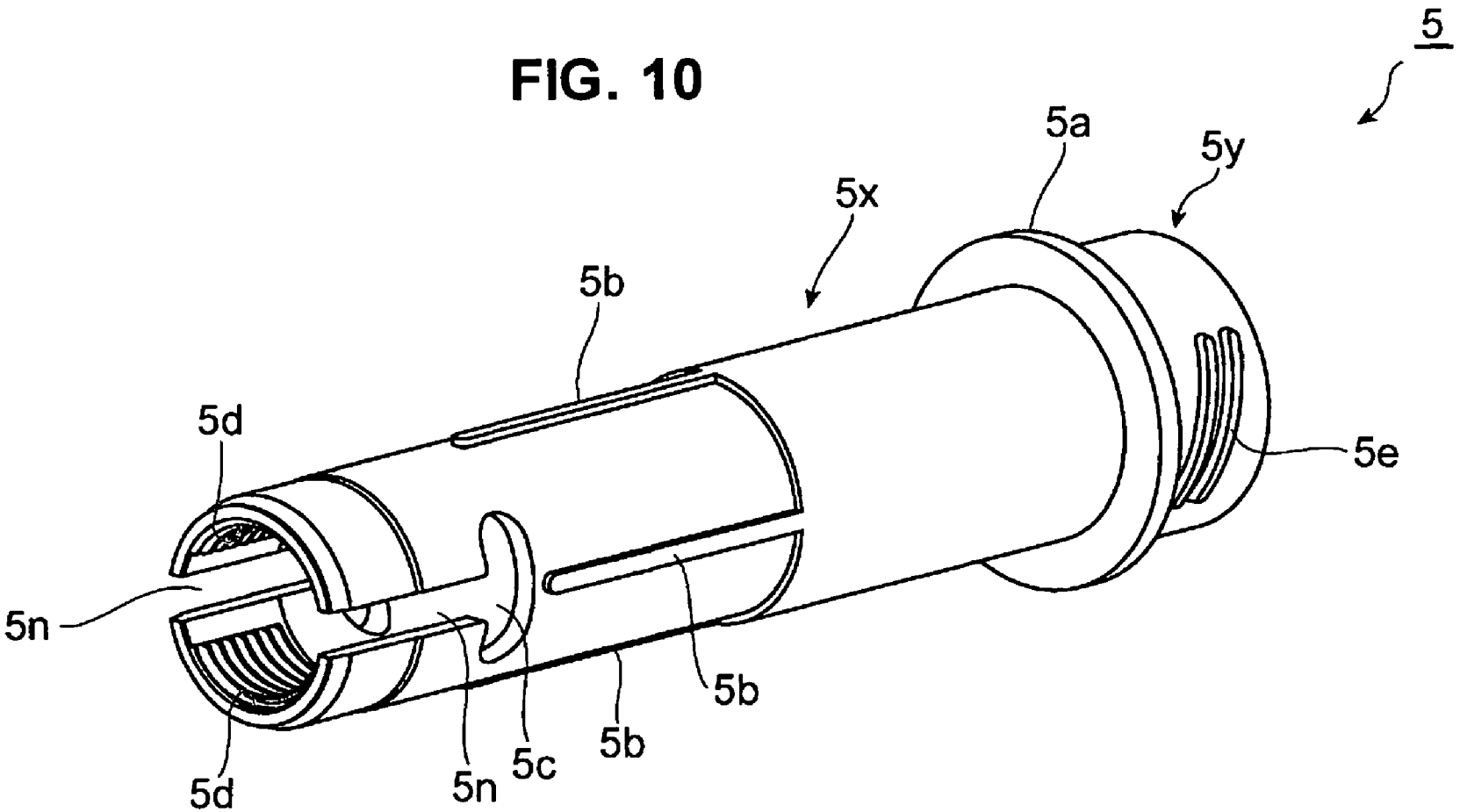
FIG. 10 is a perspective view showing the movable thread tube in FIGS. 1 to 4.
Figure 11:
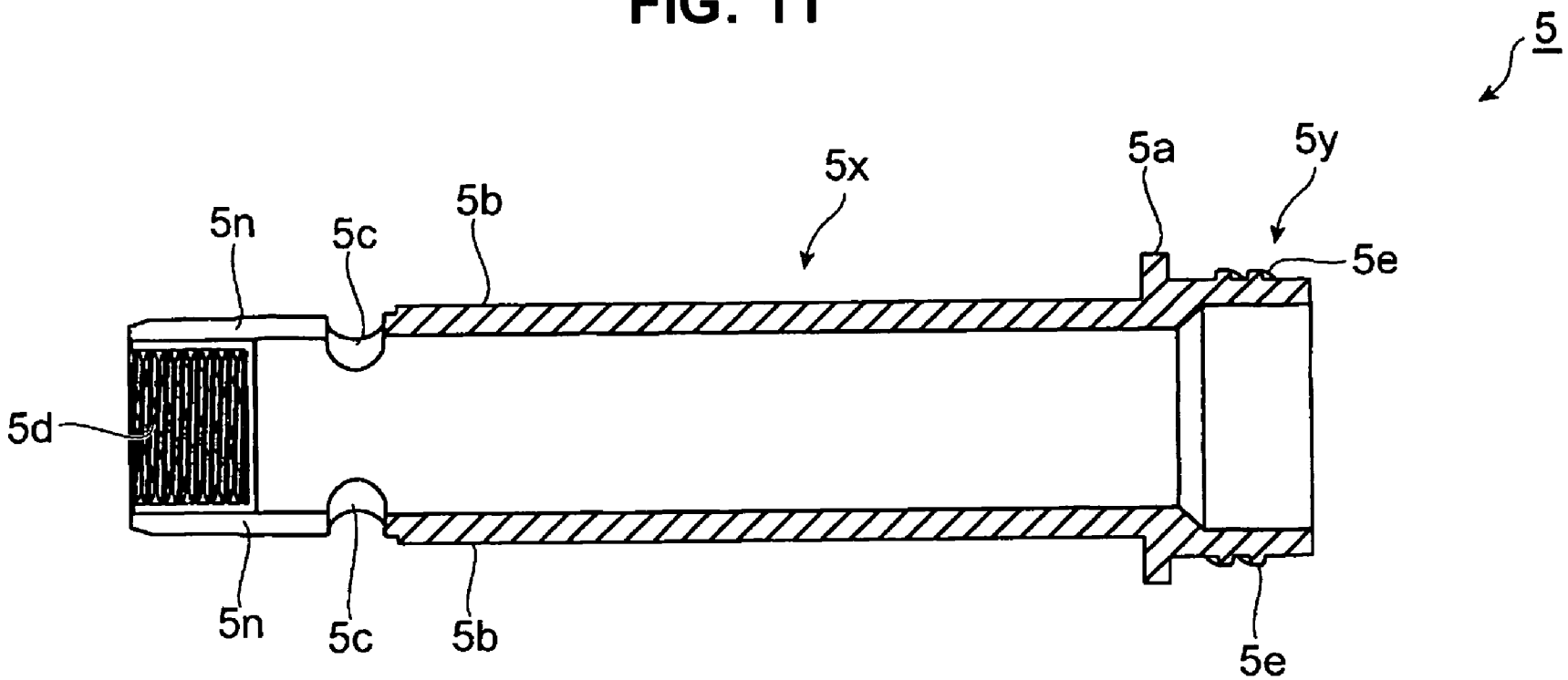
FIG. 11 is a longitudinal sectional view of the movable thread tube shown in FIG. 10.
Figure 12:
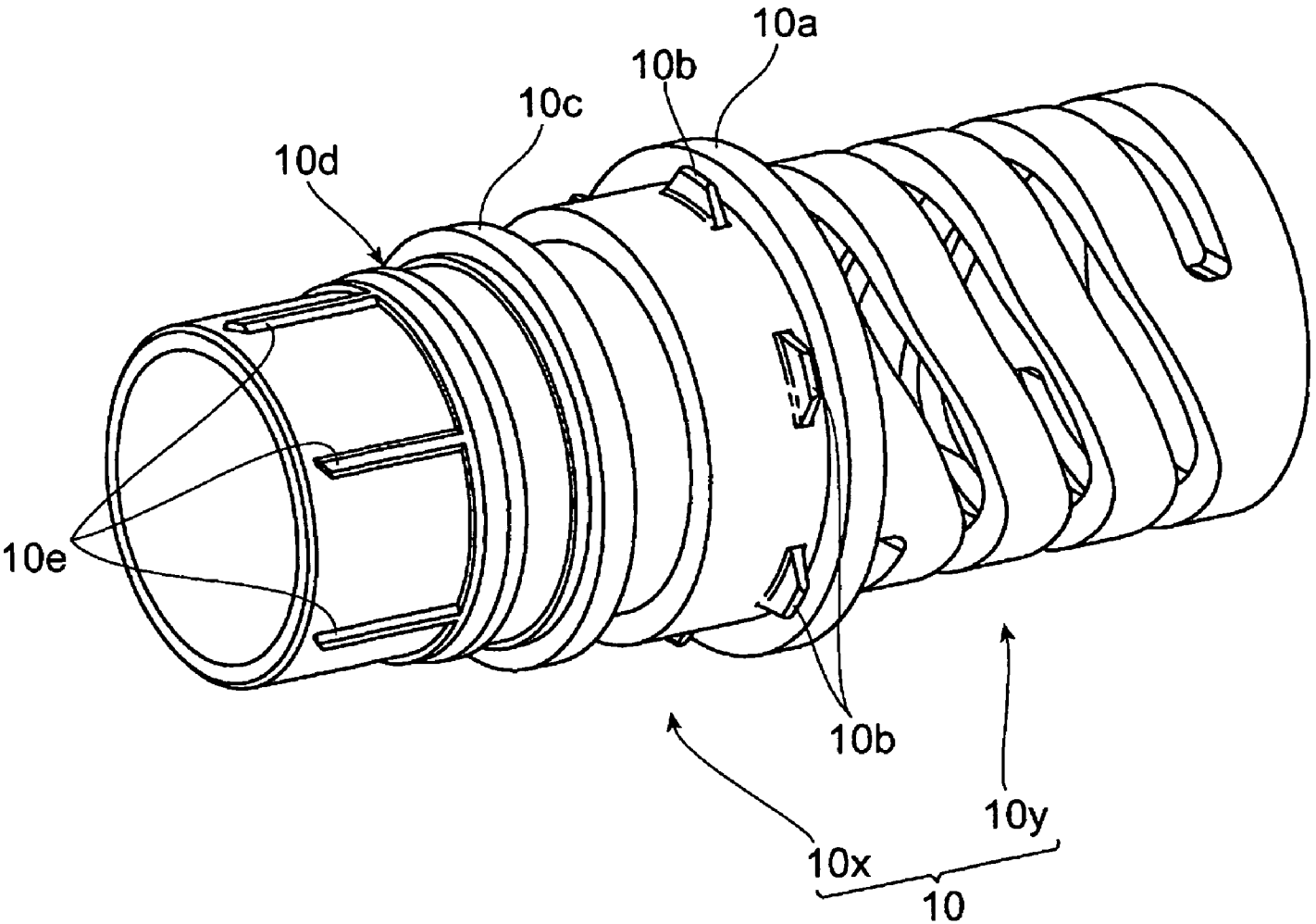
FIG. 12 is a perspective view showing a rotating member in FIGS. 1 to 4.
Figure 13:
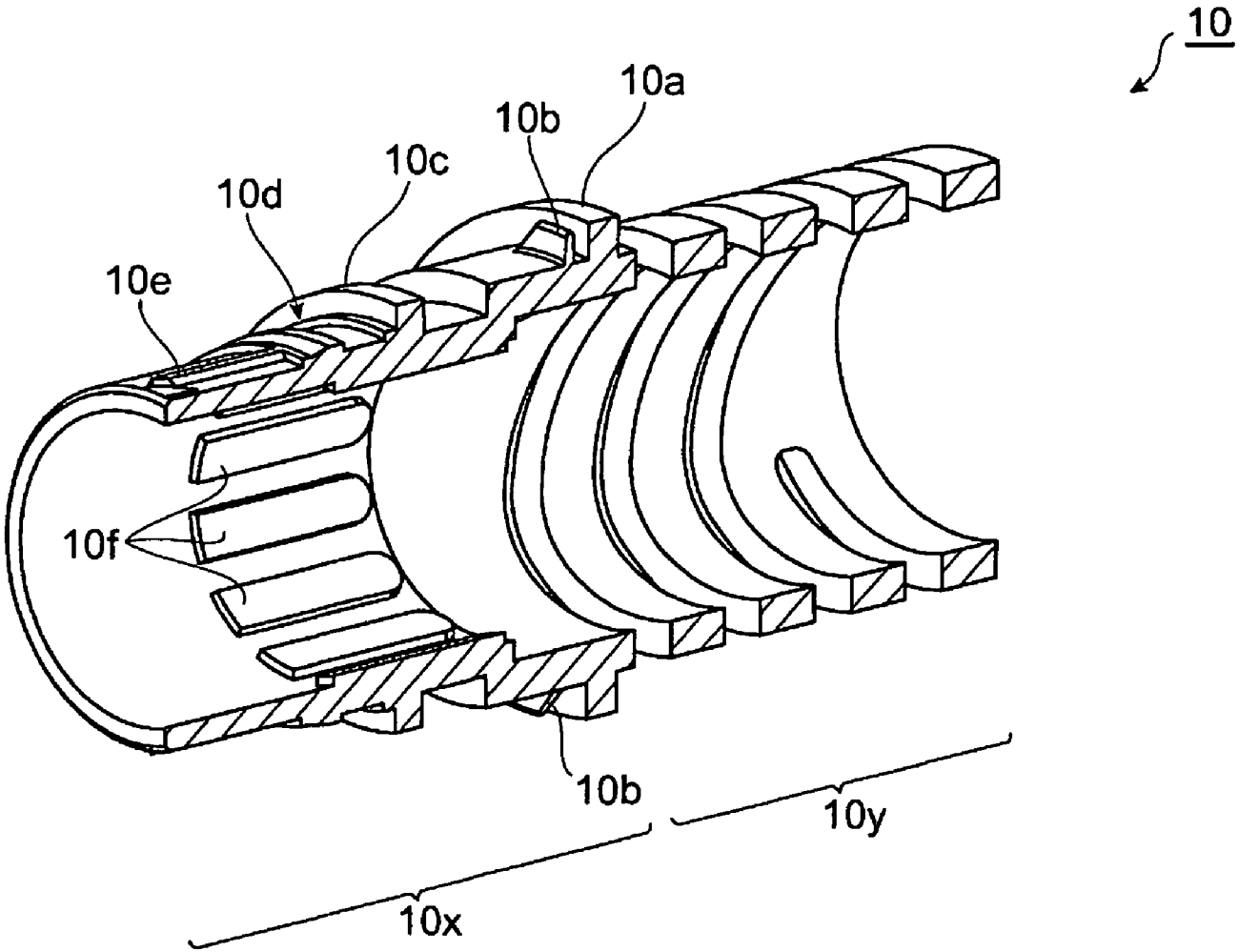
FIG. 13 is a longitudinal sectional perspective view of the rotating member shown in FIG. 12.
Figure 14:
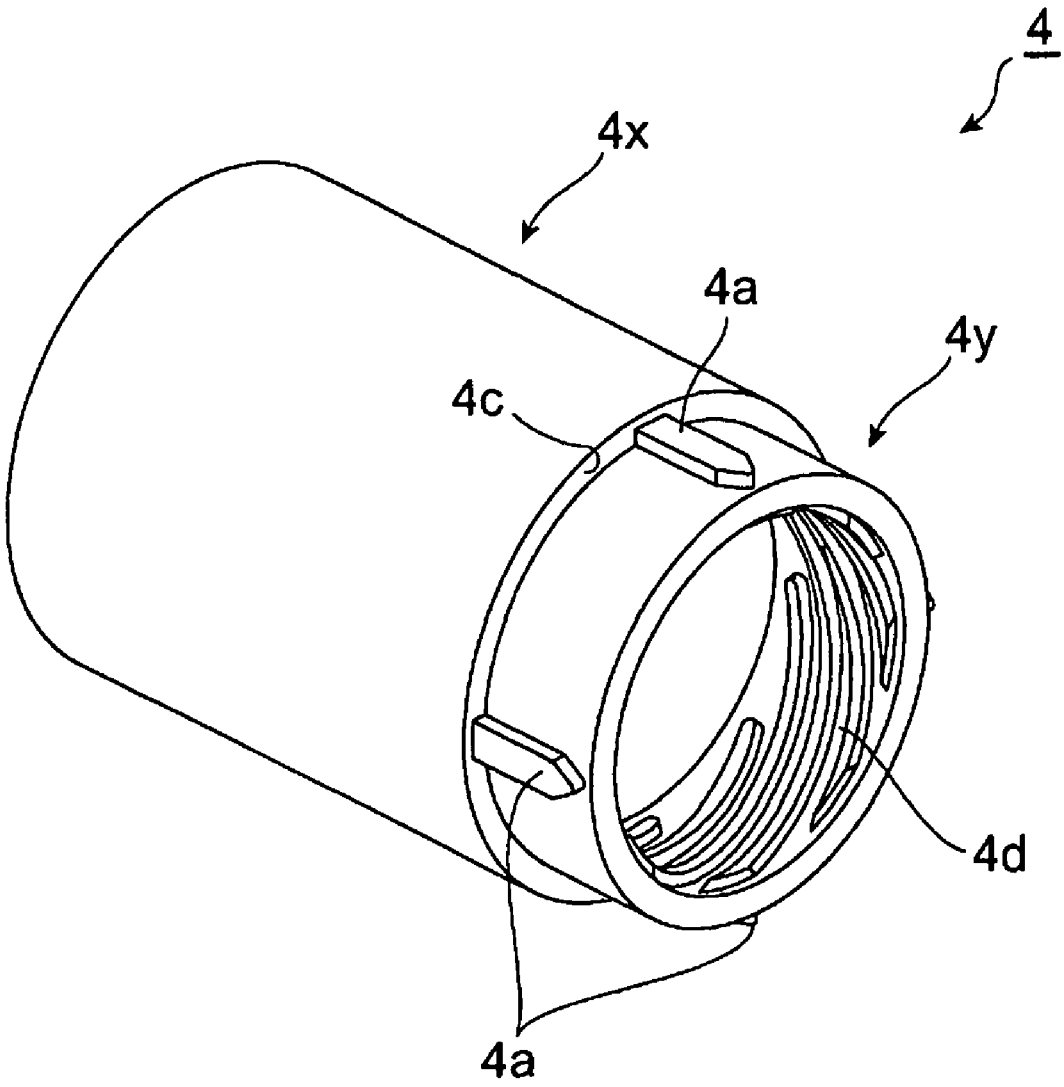
FIG. 14 is a perspective view showing a thread tube in FIGS. 1 to 4.
Figure 15:
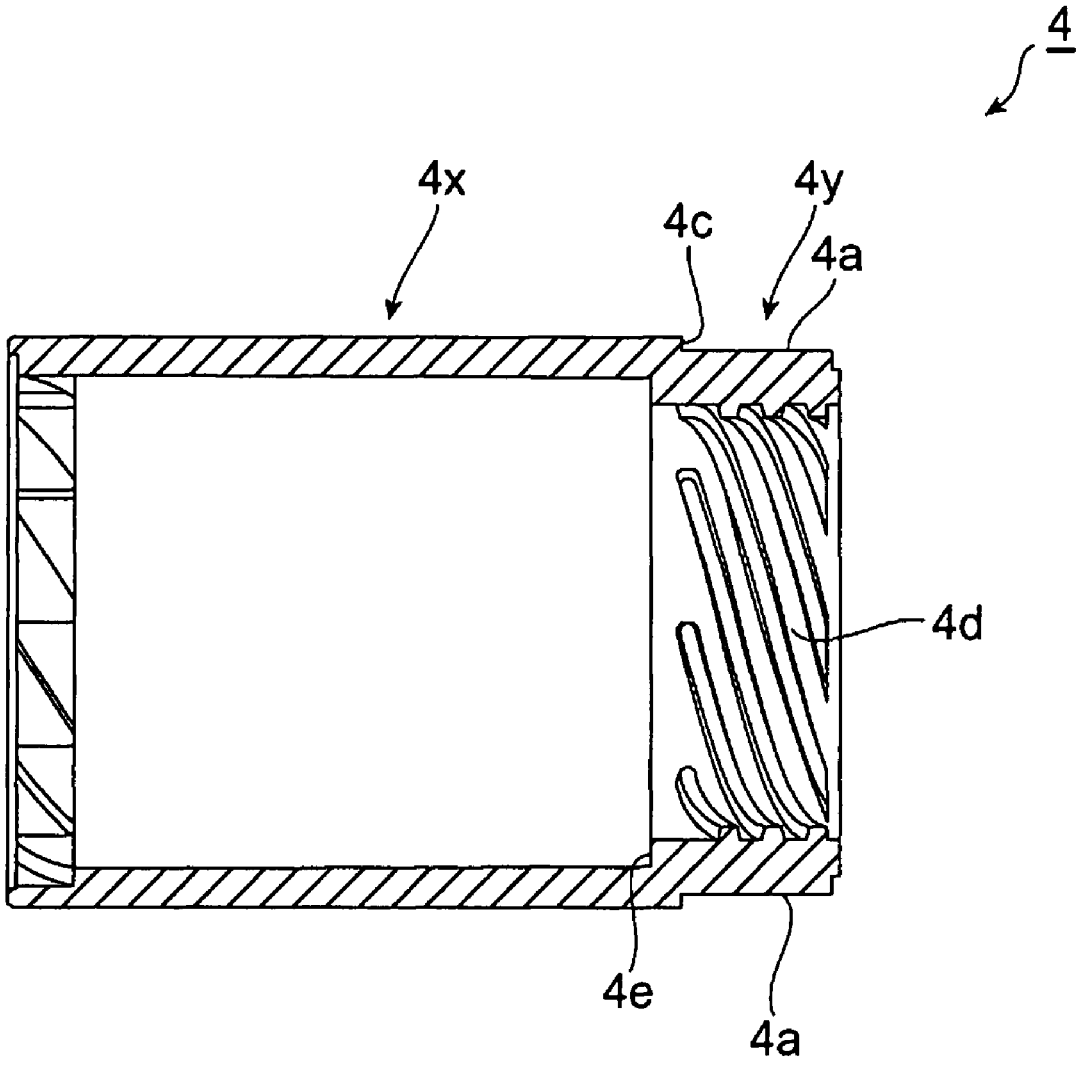
FIG. 15 is a longitudinal sectional view of the thread tube shown in FIG. 14.
Figure 16:
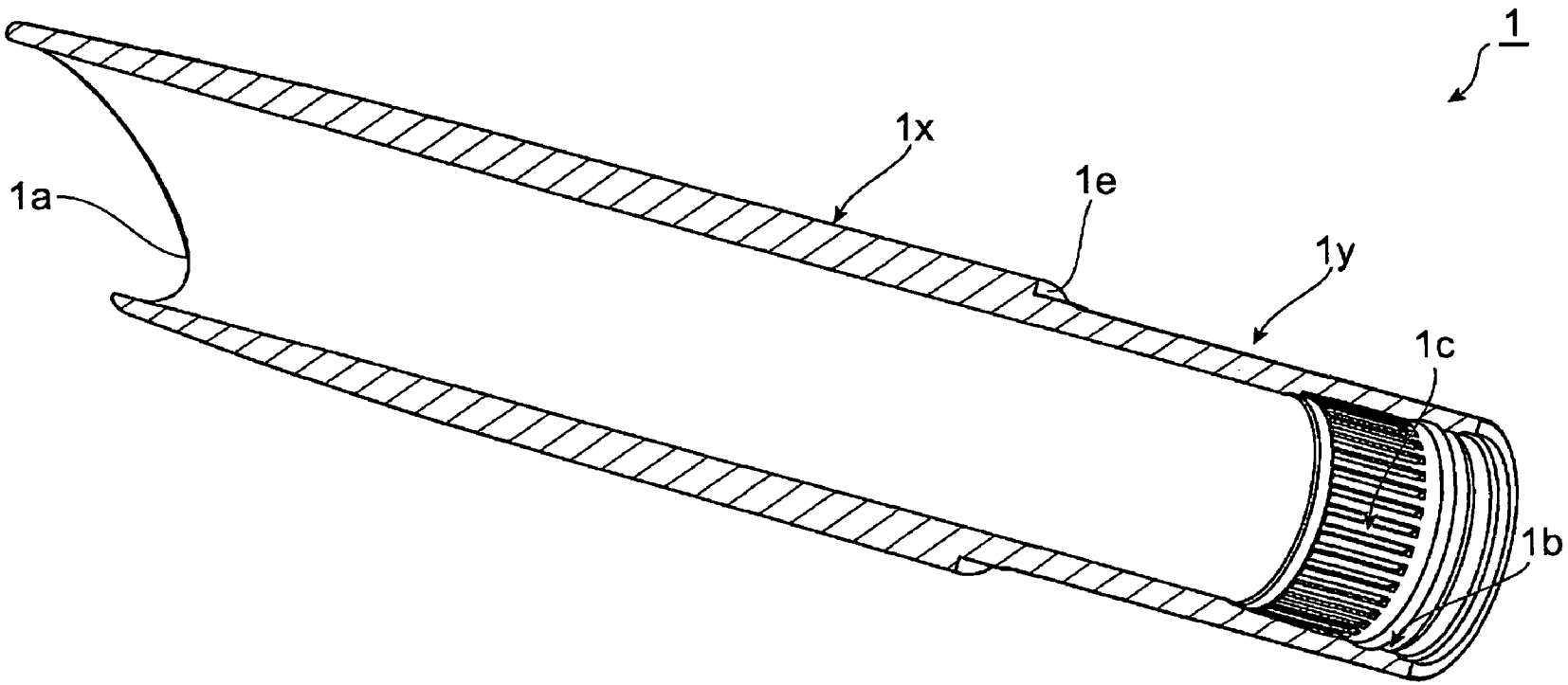
FIG. 16 is a longitudinal sectional perspective view showing a filling member in FIGS. 1 to 4.
Figure 17:
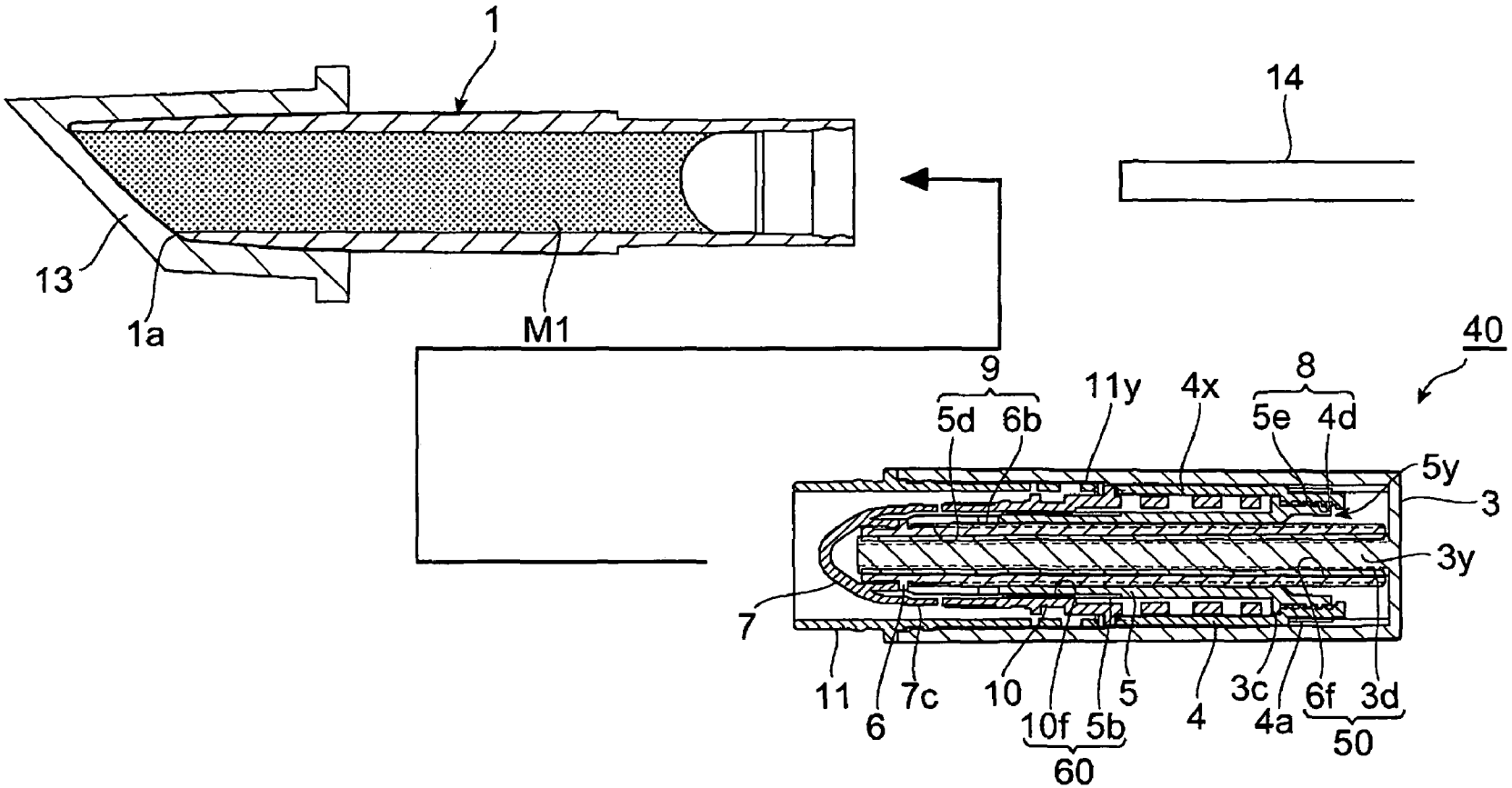
FIG. 17 is an explanatory view showing a manufacturing procedure of the stick-shaped material extruding container in accordance with the first embodiment of the present invention.

FIGS. 1 to 4 are respective longitudinal sectional views showing respective states of a stick-shaped material extruding container in accordance with the first embodiment of the present invention, FIG. 5 is a broken perspective view showing a main body tube, FIGS. 6 and 7 are respective views showing an internal member, FIGS. 8 and 9 are respective views showing a movable body, FIGS. 10 and 11 are respective views showing a movable thread tube, FIGS. 12 and 13 are respective views showing a rotating member, FIGS. 14 and 15 are respective views showing a thread tube, FIG. 16 is a longitudinal sectional perspective view showing a filling member, FIGS. 17 and 18 are respective explanatory views showing a manufacturing procedure of the stick-shaped material extruding container. The stick-shaped material extruding container in accordance with the present embodiment can accommodate the stick-shaped material and can appropriately extrude the stick-shaped material on the basis of an operation of a user.

In this case, the stick-shaped material can be, for example, various stick-shaped cosmetic materials including a lip stick, a lip gloss, an eye liner, an eye color, an eyebrow, a lip liner, a cheek color, a concealer, a beauty stick, a hair color or the like, and a stick-shaped core such as a writing instrument or the like, and it is preferable, in view of generation of a closely attaching action to a piston 7 or a filling member 1 mentioned below, to employ a very soft (semisolid, soft solid, soft, jelly-like or mousse-like) stick-shaped material. Further, it is possible to use a small-diameter stick-shaped material having an outer diameter of 1 mm or less, and a thick stick-shaped material having an outer diameter of 10 mm or more.

As shown in FIG. 1, a stick-shaped material extruding container 100 is provided with a tubular filling member 1 being open at both ends, and a main body tube (a main body) 3 where a rear portion of the filling member 1 is inserted to a front portion thereof and the filling member 1 is coupled so as to be relatively rotatable and be undetachable in an axial direction, as an outer shape structure. A container front portion is constructed by the filling member 1, and a container rear portion is constructed by the main body tube 3.

Further, the stick-shaped material extruding container 100 is approximately provided in an inner portion with a stick-shaped material M loaded in the filling member 1, a thread tube 4 coupled to the main body tube 3 so as to be synchronously rotatable and be undetachable in the axial direction, a rotating member 10 coupled to the filling member 1 so as to be synchronously rotatable and be undetachable in the axial direction, an intermediate member 11 coupled to the main body tube 3 so as to be synchronously rotatable and be undetachable in the axial direction and elastically pressing the rotating member 10 in the axial direction so as to make it undetachable in the axial direction, a movable thread tube 5 engaging with the rotating member 10 so as to be synchronously rotatable and be movable in the axial direction, engaging with the thread tube 4 via a first engagement portion 8, moving forward when the filling member 1 constructing the container front portion and the main body tube 3 constructing the container rear portion are relatively rotated in a feeding out direction corresponding to one direction, stopping forward movement when if it moves forward to a predetermined forward moving limit, moving backward when the filling member 1 and the main body tube 3 are relatively rotated in a feeding back direction corresponding to the other direction in an opposite direction to the one direction, and stopping backward movement when it moves backward to a predetermined backward moving limit, a movable body 6 engaging with the main body tube 3 so as to be synchronously rotatable and be movable in the axial direction, engaging with the movable thread tube 5 via a second engagement portion 9, moving forward independently as well as moving forward together with the movable thread tube 5 when the filling member 1 and the main body tube 3 are relatively rotated in one direction, moving forward independently when the movable thread tube 5 reaches the forward moving limit and the filling member 1 and the main body tube 5 are relatively rotated further in the same direction, moving backward independently at the same time of moving backward together with the movable thread tube 5 when the filling member 1 and the main body tube 3 are relatively rotated in the other direction, and stopping backward movement together with the movable thread tube 5 when the movable thread tube 5 reaches the backward moving limit, and a piston (a piston-like extruding portion) 7 installed to a leading end portion of the movable body 6 and inserted into the filling member 1 so as to slide.

The main body tube 3 is structured, as shown in FIG. 5, such as to be provided with a main body portion 3*x* constructed in a closed-end cylindrical shape, and a shaft body 3*y* provided in a rising manner at a center of a bottom portion of the main body portion 3*x* toward a leading end side.

The main body portion 3*x* is provided with annular convex and concave portions (in which convex and concave portions are lined up in the axial direction) 3*a* for engaging the intermediate member 11 in the axial direction, on an inner peripheral surface of a leading end portion thereof, and is provided with a knurling 3*b* in which a lot of concave and convex portions are provided in parallel in a peripheral direction and the concave and convex portions extend at a predetermined length in the axial direction, as a structure for engaging the intermediate member 11 in a rotating direction, on an inner peripheral surface at a rear side of the annular convex and concave portions 3*a*. Further, the main body portion 3*x* is provided with a lot of protrusions 3*c* provided in parallel along the peripheral direction and extending toward a leading end side from a bottom portion, as a structure for engaging the thread tube 4 in the rotating direction, on an inner peripheral surface at the bottom portion side.

The shaft body 3*y* is formed in a non-circular cross sectional shape provided with protrusions 3*d* which are arranged at six uniformly arranged positions along the peripheral direction on an outer peripheral surface of a columnar body in such a manner as to protrude to an outer side in a radial direction so as to extend in the axial direction, and the protrusions 3*d* are formed as a rotation stopper constituting one of rotation stop mechanisms (rotation stop portions) 50 of the main body tube 3 and the movable body 6.

The intermediate member (the rotation member pressing member) 11 is formed as an injection molded product by a resin, and is formed in a stepped cylindrical shape provided with a spring portion 11*y* at a rear portion side, and a main body portion 11*x* at a front side of the spring portion 11*y*, as shown in FIGS. 6 and 7.

The main body portion 11*x* is provided with a collar portion 11*a* in which an outer surface in the middle in the axial direction is enlarged in the radial direction, and is provided with annular concave and convex portions (in which concave and convex portions are lined up in the axial direction) 11*b* as a structure engaging with the annular convex and concave portions 3*a* of the main body tube 3 in the axial direction, on an outer peripheral surface at a rear side of the collar portion 11*a*. Further, a plurality of protrusions 11*d* arranged in parallel along the peripheral direction and extending in the axial direction are provided as a structure engaging with the knurling 3*b* of the main body tube 3 in the rotating direction, on an outer peripheral surface between the annular concave and convex portion 11*b* of the main body portion 11*x* and the spring portion 11*y*. Further, a plurality of protruding portions (so-called dowels) 11*c* for detachably engaging the cap 12 shown in FIG. 1 in the axial direction are provided along the peripheral direction, on an outer peripheral surface at a front side of the collar portion 11*a* of the main body portion 11*x*.

The spring portion 11*y* is constituted by a so-called resin spring which is integrally provided continuously at a rear side of the main body portion 11*x* and is made extendable and contractable in the axial direction, and is provided for applying a good sliding rotational resistance at a time when the filling member 1 and the main body tube 3 are relatively rotated. The spring portion 11*y* can be changed in its strength in accordance with a shape of a notch, and can be omitted.

The intermediate member 11 provided with the main body portion 11*x* and the spring portion 11*y* is structured, as shown in FIG. 1, such that a portion at a rear side of the collar portion 11*a* is inserted into the main body tube 3, a rear end surface of the collar portion 11*a* is brought into contact with the leading end surface of the main body tube 3, the protrusions 11*d* are engaged with the knurling 3*b* of the main body tube 3 in the rotating direction, and the annular concave and convex portion 11*b* is engaged with the annular convex and concave portion 3*a* of the main body tube 3 in the axial direction, thereby being installed to the main body tube 3 so as to be synchronously rotatable and be undetachable in the axial direction, and being integrated with the main tube portion 3.

The movable body 6 is formed as an injection molded product by the resin, is structured in a cylindrical shape having a collar portion 6*a* at a leading end side, and is provided with a male thread 6*b* constituting one of a second engagement portion (an engagement mechanism) 9, on an outer peripheral surface extending from a rear side of the collar portion 6*a* to a rear end, as shown in FIGS. 8 and 9. An outer shape of the collar portion 6*a* positioned at a front side of the male thread 6*b* is formed in a shape provided with two flat surface portions 6*aa* oppositely on an outer periphery of the circular shape.

Further, the front side of the collar portion 6*a* of the movable body 6 is formed as a cylinder portion having a smaller diameter than the collar portion 6*a*, and a small-diameter collar portion 6*c* is provided at a leading end of the cylinder portion, whereby an annular groove portion 6*d* which is wide in the axial direction is formed between the small-diameter portion 6*c* and the collar portion 6*a*. The wide annular groove portion 6*d* is provided for engaging the piston 7 so as to be movable in the axial direction.

Further, an inner peripheral surface corresponding to a tube hole of the movable body 6 is formed as a hole having a circular cross sectional shape, and protrusions 6*f* radially protruding at a predetermined length toward an inner side and extending in the axial direction are provided at six uniformly arranged positions along the peripheral direction of a peripheral surface of the hole. The protrusions 6*f* are formed as a rotation stopper constituting the other of the rotation stop portion (the rotation stop mechanism) 50 between the main body tube 3 and the movable body 6.

The movable body 6 is fitted onto the shaft body 3*y* of the main body tube 3, as shown in FIG. 1, and each of the protrusions 6*f* enters into a portion between the protrusions 3*d* and 3*d* of the shaft body 3*y* of the main body tube 3 so as to engage in the rotating direction, thereby the movable body 6 being installed to the main body tube 3 so as to be synchronously rotatable and be movable in the axial direction.

The piston 7 is molded by a comparatively soft raw material such as a polypropylene (PP), a high density polyethylene (HDPE), a linear low density polyethylene (LLDP) or the like, is formed in a shape which is curved like as an umbrella shape toward the leading end, and is provided with a concave portion 7*a* recessed in such a manner as to copy an outer surface from a rear end surface toward a leading end side. A cylinder portion 7*d* extending short toward a rear side is provided in the middle in the axial direction of the inner surface of the piston 7, and an annular protruding portion 7*b* is provided on an inner peripheral surface of the cylinder portion 7*d*. The annular protruding portion 7*b* and a rear end surface 7*f* of the cylinder portion 7*d* are provided for engaging with the movable body 6 so as to be movable in the axial direction. Further, the piston 7 is provided with an annular protruding portion 7*c* closely attached to the inner peripheral surface of the filling member 1 so as to secure an airtightness on an outer peripheral surface of a rear end portion thereof.

The piston 7 is fitted onto the movable body 6, and the annular protruding portion 7*b* enters into the annular groove portion 6*d* of the movable body 6, thereby the piston 7 being installed to the movable body 6 so as to be rotatable and be movable in the axial direction (movable within a predetermined range, which will be described below in detail). In this case, the piston 7 and the movable body 6 can be structured such as to be synchronously rotatable. Further, the piston 7 is set to such a state in which the rear end surface 7*f* of the cylinder portion 7*d* is brought into contact with the surface at the front side of the collar portion 6*a* of the movable body 6, in the stick-shaped material extruding container 100 in the initial state shown in FIG. 1.

The movable thread tube 5 is formed as an injection molded product by a resin, is structured in a cylindrical shape having a collar portion 5*a* at a rear end side as shown in FIGS. 10 and 11, and is structured such that a front side of the collar portion 5*a* forms an outer diameter small-diameter portion 5*x* and a rear side thereof forms an outer diameter large-diameter portion 5*y*. An outer peripheral surface of the outer diameter large-diameter portion 5*y* is provided with a plurality of engagement projections (circular arc protrusions) 5*e* serving as a male thread constituting one of the first engagement portion (the engagement mechanism) 8.

The outer diameter small-diameter portion 5*x* of the movable thread tube 5 is provided with protrusions 5*b* extending in the axial direction at four uniformly arranged positions along the peripheral direction, on an outer peripheral surface at the middle in the axial direction, for engaging the rotating member 10 in the rotating direction. The protrusions 5*b* are formed as a rotation stopper constructing one of a rotation stop mechanism (a rotation stop portion) 60 between the rotating member 10 and the movable thread tube 5.

Further, the movable thread tube 5 is provided with a pair of slits 5*n* extending from a leading end of the outer diameter small-diameter portion 5*x* to a portion near the protrusions 5*b* and making the inner side communicate with the outer side, at both sides of the axis, and a long hole 5*c* extending at a predetermined length in the peripheral direction is continuously provided in a root portion of each of the slits 5*n*. Functions of the slits 5*n* and the long holes 5*c* will be described later.

Further, the outer diameter small-diameter portion 5*x* of the movable thread tube 5 is provided with a female thread 5*d* constituting the other of the second engagement portion (the thread mechanism) 9 on an inner surface of a leading end portion thereof in such a manner as to cross the slits 5*n* and 5*n* and form a semicircular arc shape.

The female thread 5*d* of the movable thread tube 5 having the structure mentioned above is molded by a core pin (a molding die) having a thread portion on an outer peripheral surface for forming the female thread 5*d*. The core pin is drawn out to a leading end side or a rear end side in the axial direction, so-called forcedly drawn out, after hardening of the resin at a time of the resin molding, however, the leading end portion of the movable thread tube 5 is opened to an outer side in the diametrical direction by the slits 5*n* and 5*n* at a time of forcedly drawing, whereby the core pin is easily drawn out without giving any damage to the female thread 5*d*. Further, when the leading end portion of the movable thread tube 5 is opened to the outer side in the diametrical direction, stress applied to the root portion of the slits 5*n* and 5*n* is dispersed by the long holes 5*c* and 5*c*, thereby preventing the damage from being given to the movable thread tube 5. As mentioned above, since the movable thread tube 5 is structured such that it is possible to employ the forcedly drawing method in place of a method of turning and drawing the core pin by using a motor, a rack or the like, it is possible to mold rapidly, and it is possible to reduce a manufacturing cost and a metal mold cost.

Further, the movable thread tube 5 is fitted onto the movable body 6 as shown in FIG. 1, and the female thread 5*d* is set to a state of engaging with the male thread 6*b* of the movable body 6.

The rotating member 10 is formed as an injection molded product by a resin, and is formed in a stepped cylindrical shape provided with a spring portion 10*y* at a rear portion side, and a main body portion 10*x* at a front side of the spring portion 10*y*, as shown in FIGS. 12 and 13.

The main body portion 10*x* is structured such that an outer diameter is made larger in stages toward a rear side, is provided at a rear portion with a collar portion 10*a* for holding the thread tube 4 in the axial direction, and is provided on an outer peripheral surface at a front side of the collar portion 10*a* with a plurality of protruding portions 10*b* arranged in line along the peripheral direction as a structure pressed by the spring portion 11*y* of the intermediate member 11. Further, a collar portion 10*c* for contacting with the rear end surface of the filling member 1 is provided on an outer peripheral surface at a front side of the protruding portion 10*b* of the main body portion 10*x*, and an annular convex and concave portion 10*d* is provided as a structure for engaging the filling member 1 in the axial direction, on an outer peripheral surface at a front side of the collar portion 10*c*. Further, a plurality of protrusions 10*e* arranged in parallel along the peripheral direction and extending in the axial direction are provided as a structure for engaging the filling member 1 in the rotating direction, on an outer peripheral surface at a front side of the annular convex and concave portion 10*d* of the main body portion 10*x*. Further, protrusions 10*f* extending in the axial direction are provided as a structure for engaging with the protrusions 5*b* of the movable thread tube 5 in the rotating direction at a plurality of positions along the peripheral direction, on an inner peripheral surface of the main body portion 10*x*. The protrusions 10*f* are structured as a rotation stopper constituting the other of the rotation stop mechanism (the rotation stop portion) 60 between the rotating member 10 and the movable thread tube 5.

The spring 10*y* is integrally provided at a rear side of the main body portion 10*x* continuously, and is constituted by a so-called resin spring which can be contracted and extended in the axial direction.

The rotating member 10 provided with the main body portion 10*x* and the spring portion 10*y* is fitted onto the movable thread tube 5 as shown in FIG. 1, and the protruding portion 10*b* is pressed to the spring portion 11*y* of the intermediate member 11, thereby being prevented from breaking away to the front side in the axial direction. The protrusions 10*f* are engaged with the protrusions 5*b* of the movable thread tube 5 in the rotating direction in this state, thereby making the movable thread tube 5 synchronously rotatable and movable in the axial direction. Further, in this state, a predetermined space for forward moving the movable thread tube 5 is provided between the rear end surface of the spring portion 10*y* of the rotating member 10 and the collar portion 5*a* of the movable thread tube 5. In this case, the predetermined space may be omitted.

The thread tube 4 is formed as an injection molded product by a resin, is structured in a stepped cylindrical shape as shown in FIGS. 14 and 15, and is provided with a small-diameter portion 4*y* at a rear side, and a large-diameter portion 4*x* at a front side thereof via a step surface 4*c*. A plurality of protrusions 4*a* arranged in parallel along the peripheral direction and extending in the axial direction are provided as a structure for engaging with the protrusions 3*c* of the main body tube 3 in the rotating direction, on an outer peripheral surface of the small-diameter portion 4*y*. An inner peripheral surface of the small-diameter portion 4*y* is formed so as to have a smaller diameter than an inner peripheral surface of the large-diameter portion 4*x*, and a female thread 4*d* constituting the other of the first engagement portion (the engagement mechanism) 8 is provided on an inner peripheral surface of the small-diameter portion 4*y*.

The thread tube 4 is inserted between the main body tube 3 and the movable thread tube 5 as shown in FIG. 1, and a leading end surface thereof is pressed to the collar portion 10*a* of the rotating member 10, whereby the protrusions 4*a* are engaged with the protrusions 3*c* of the main body tube 3 in the rotating direction, and thus the thread tube 4 is installed to the main body tube 3 so as to be synchronously rotatable and undetachable in the axial direction, in a state in which the step surface 4*c* is brought into contact with the leading end surface of the protrusions 3*c* of the main body tube 3. Further, in this state, the female thread 4*d* of the thread tube 4 is set to a state of being engaged with the engagement projections 5*e* of the movable thread tube 5.

In the first engagement portion 8 constituted by the engagement projections 5*e* of the movable thread tube 5 and the female thread 4*d* of the thread tube 4, and the second engagement portion 9 constituted by the female thread 5*d* of the movable thread tube 5 and the male thread 6*b* of the movable body 6, a lead of the first engagement portion 8 is made larger than a lead of the second engagement portion 9, as shown in FIGS. 11 and 15. In this case, the lead means a distance of moving in the axial direction at a time of one rotation of the thread.

Further, as shown in FIG. 17, the main body side tube body constituted by the main body tube 3 and the intermediate member 11 is provided with (incorporates) the extruding mechanism having the rotation stop portion 50 constituted by the first and second engagement portions 8 and 9, the protrusions 6*f* of the movable body 6 and the protrusions 3*d* of the shaft body 3*y* of the main body tube 3, and the rotation stop portion 60 constituted by the protrusions 5*b* of the movable thread tube 5 and the protrusions 10*f* of the rotating member 10, the thread tube 4, the movable thread tube 5, the movable body 6, the piston 7 and the rotating member 10, whereby a main body side assembly 40 is structured.

In this case, it is preferable that the thread tube 4, the movable thread tube 5, the movable body 6, the rotating member 10 and the intermediate member 11 are made by an injection molded raw material having a high sliding performance, such as a polyacetal (POM), an ultra high molecular weight polyethylene (UHMWPE) or the like.

The filling member 1 is provided for loading the stick-shaped material M in an inner portion as shown in FIG. 1, and is provided so as to make the stick-shaped material M appear from the leading end portion in accordance with an operation by a user. It is preferable that the filling member 1 and the cap 12 are formed by an injection molding raw material such as the ABS, a polypropylene (PP), a polyethylene terephthalate (PET), a poly-cyclohexane dimethylene terephthalate (PCT) group PETG, PCTG and PCTA and the like, and that a transparent raw material is used in order to check out a color tone and an installed state of the stick-shaped material M, or a colored material having a color of the stick-shaped material M or another color is used.

Figure 2:
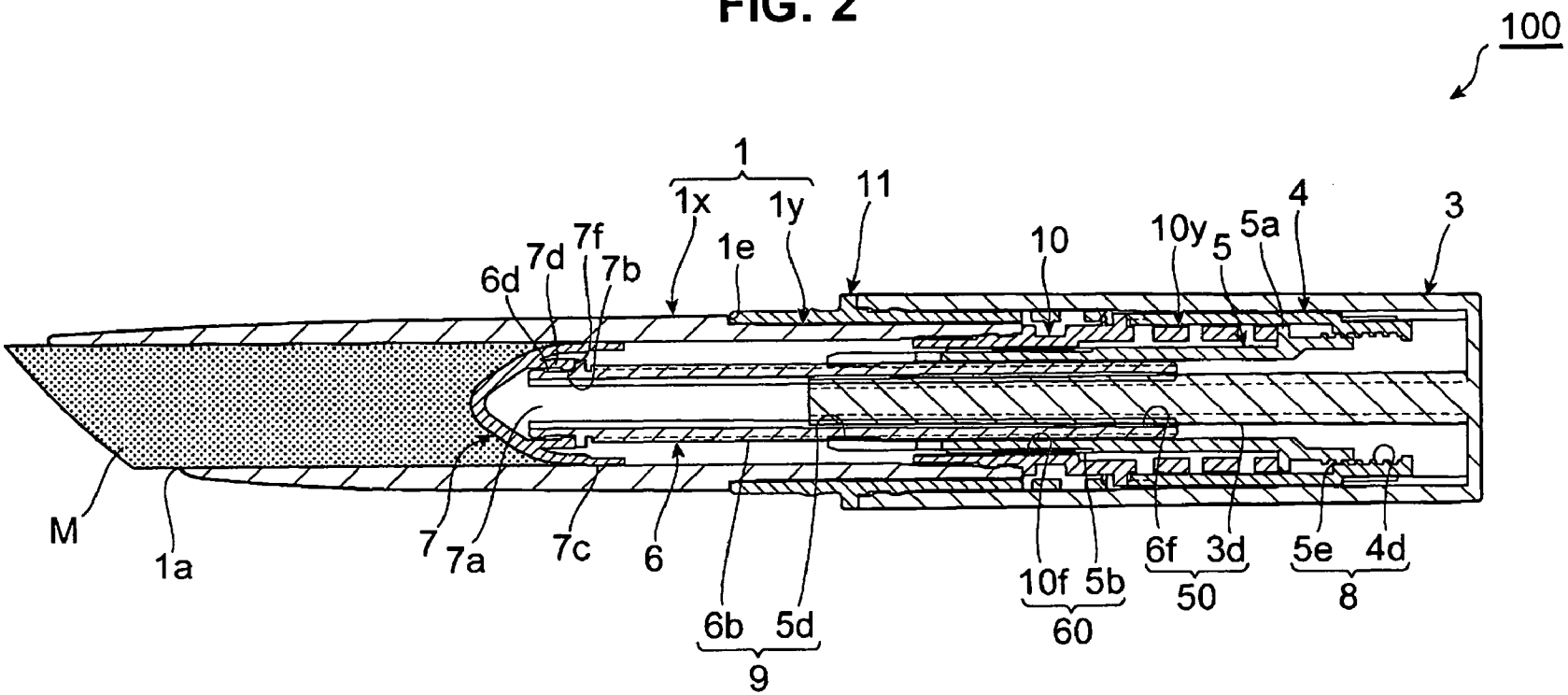
FIG. 2 is a longitudinal sectional view at a time when a cap is detached from a state shown in FIG. 1 and a movable thread tube and a movable body are moved forward on the basis of an operation of a user.

As shown in FIGS. 1, 2 and 16, the filling member 1 is structured in a stepped cylindrical shape, and is provided with a small-diameter portion 1*y* at a rear side, and a large-diameter portion 1*x* at a front side thereof via a step surface 1*e*. The large-diameter portion 1*x* is formed in such a shape that an outer periphery is somewhat tapered toward a leading end, and an opening 1*a* at the leading end is formed as an opening for making the stick-shaped material M appear. Further, in this case, the leading end surface of the filling member 1 and the leading end surface of the stick-shaped material M are formed as an inclined surface which is inclined with respect to a surface orthogonal to the axis as seen in the vertical direction to a paper surface of FIG. 1.

As shown in FIG. 16, an annular concave and convex portion 1*b* is provided as a structure engaging with the annular convex and concave portion 10*d* of the rotating member 10 in the axial direction, on an inner peripheral surface of a rear end portion of the small-diameter portion 1*y*, and a knurling 1*c*, in which a lot of concave and convex portions are provided in parallel in the peripheral direction and the concave and convex portions extend at a predetermined length in the axial direction, is provided as a structure engaging with protrusions 10*e* of the rotating member 10 in the rotating direction, on an inner peripheral surface at a front side of the annular concave and convex portion 1*b*.

The filling member 1 is inserted to a portion between the rotating member 10 and the piston 7, and the intermediate member 11 from a rear portion side thereof, as shown in FIG. 1, is structured such that a rear end surface is brought into contact with the collar portion 10*c* of the rotating member 10, the annular concave and convex portion 1*b* is engaged with the annular convex and concave portion 10*d* of the rotating member 10 in the axial direction, and the protrusions 10*e* of the rotating member 10 are engaged with the knurling 1*c* in the rotating direction, whereby the filling member 1 is installed to the rotating member 10 so as to be synchronously rotatable and be undetachable in the axial direction, and is integrated with the rotating member 10. The rotating member 10 is prevented from breaking to the front side in the axial direction and is synchronously rotatable with the movable thread tube 5 by the spring portion 11*y* of the intermediate member 11 integrated with the main body tube 3, as mentioned above, the movable thread tube 5 is engaged with the movable body 6 via the second engaging portion 9, and the movable body 6 is synchronously rotatable with the main body tube 3. Accordingly, the filling member 1 is installed to the main body tube 3 so as to be rotatable and undetachable in the axial direction. Further, the piston 7 (the annular protruding portion 7*c*) is inserted into the rear end portion of the filling member 1 so as to be closely attached to the filling member 1.

Further, as shown in FIG. 1, since the cap 12 is detachably installed to the intermediate member 11, the filling member 1 is protected by the cap 12.

Next, a description will be given of an example of a manufacturing procedure of the stick-shaped material extruding container 100 having the structure mentioned above with reference to FIG. 17. First, the movable thread tube 5 is screwed to the movable body 6 until it comes to the initial position. Alternatively, it is pressed to the initial position while forcedly getting over a thread ridge. Next, the rotating member 10 is fitted onto the movable thread tube 5 in such a manner that the protrusions 5*b* of the movable thread tube 5 engage with the portions between the protrusions 10*f* and 10*f* of the rotating member 10, the piston 7 is next installed to the movable body 6, the large-diameter portion 4*x* of the thread tube 4 is inserted to the outer-diameter large-diameter portion 5*y* of the movable thread tube 5, and the female thread 4*d* on the inner peripheral surface of the thread tube 4 is engaged with the engagement projections 5*e* on the outer peripheral surface of the movable thread tube 5, and is rotated in the feeding back direction so as to be moved back to the backward limit, whereby a preliminary assembly is obtained.

Next, the preliminary assembly is inserted from the opening side of the main body tube 3, the thread tube 4 is inserted to the main body tube 3 while engaging the protrusions 4*a* of the thread tube 4 with the portions between the protrusions 3*c* and 3*c* of the main body tube 3, as well as the movable body 6 is fitted onto the shaft body 3*y* while engaging the protrusions 6*f* of the movable body 6 with the portions between the projections 3*d* and 3*d* of the shaft body 3*y* of the main body tube 3. Next, the intermediate member 11 is inserted to the main body tube 3 so as to be installed, the intermediate member 11 makes the rotating member 10 and thread tube 4 via the rotating member 10 undetachable toward the front side in the axial direction, and the main body side assembly 40 is obtained.

On the other hand, as for the filling member 1, in a state in which the opening 1*a* at the leading end is closed by a seal member 13 and the filling member 1 is inverted, a predetermined amount of molten stick-shaped material M is discharged into the inner portion from a nozzle 14 so as to be loaded partway to the rear end from the leading end of the filling member 1 and form a state in which no space exists within the leading end of the filling member 1. Further, when the molten stick-shaped material M is cooled and solidified so as to form the stick-shaped material M, the leading end side of the main body assembly 40 is fitted onto the filling member 1 loaded with the stick-shaped material M from an upper side, and the filling member 1 is installed to the main body tube 3 (the intermediate member 11) while inserting the piston 7 to the filling member 1. At this time, the filling member 1 is engaged with the main body tube 3 while the inner peripheral surface thereof comes into slidable contact with the annular protruding portion 7*c* for securing an airtightness of the piston 7.

Further, when the seal member 13 is detached from the stick-shaped material extruding container obtained as mentioned above, the stick-shaped material extruding container 100 in the initial state is obtained as shown in FIG. 1. It is sanitary if the user (the consumer) detaches the seal member 13 after buying. Further, an inner shape of the cap 12 may be changed so as to be used as the seal member 13.

Further, in accordance with the other manufacturing procedure, as shown in FIG. 18, the filling member 1 is first installed to the main body side assembly 40, the assembly is set to the jig 41 in such a manner that the inclined leading end surface 1*z* of the filling member 1 becomes horizontal, and a cylindrical heat insulating member 15, for example, made of a rubber material or the like is fitted and set onto the leading end portion of the filling member 1. At this time, an inner peripheral surface of the heat insulating member 15 is provided with a step portion 15*a* in which an inner diameter at a rear side (a lower side in the drawing) is larger, an end surface 15*b* constituting the step portion 15*a* contacts with a leading end surface 1*z* of the filling member 1, and an inner peripheral surface at a front side of the step portion 15*a* of the heat insulating member 15 is made approximately flush with the opening 1*a* in the leading end of the filling member 1.

Next, a molten stick-shaped material M1 is discharged from the nozzle 14 positioned above the opening at the leading end of the heat insulating member 15, and the molten stick-shaped material M1 is loaded from the piston 7 side, and is loaded somewhat more than capacity. At this time, the air is hardly involved between the piston 7 and the molten filling material M1, and the filling material M is well retracted on the basis of a sucking action caused by the backward movement of the piston 7. Further, it is possible to prevent the surplus molten filling material M from dripping off from the leading end of the filling member 1, on the basis of the heat insulating member 15.

The molten stick-shaped material M1 is cooled and solidified, however, since the leading end side of the filling member 1 is kept warm by the heat insulating member 15 at this time, the molten stick-shaped material M1 is cooled little by little from the piston 7 side toward the leading end of the filling member 1, bubbles within the molten stick-shaped material M1 are well gone out from an upper end of the molten stick-shaped material M1, and it is possible to prevent the bubbles from staying within the stick-shaped material.

Further, after the molten stick-shaped material M1 is cooled and solidified, the stick-shaped material extruding container 100 in the initial state shown in FIG. 1 can be obtained by detaching the heat insulating member 15 and cutting the leading end of the stick-shaped material M to perform a finish processing.

In accordance with the stick-shaped material extruding container 100 structured as mentioned above, since the stick-shaped material M is loaded only in the tubular filling member 1, the thickness of the filling member 1 is set comparatively uniform and the thickness in the diametrical direction of the stick-shaped material M is made constant along the axial direction, so that it is possible to stabilize a temperature condition after loading the molten stick-shaped material M1 till the molten stick-shaped material M1 is solidified. As a result, it is possible to well load the stick-shaped material M and a manufacturing yield ratio is improved.

Further, in the stick-shaped material extruding container shown in FIG. 17, on the basis of the structure in which the filling member 1 loaded with the stick-shaped material M is assembled in the main body side assembly 40, it is easy to manufacture the container. In the stick-shaped material extruding container shown in FIG. 18, on the basis of the structure in which the stick-shaped material M is loaded in the filing member 1 assembled in the main body side assembly 40, it is further easy to manufacture the container.

Further, on the basis of the structure in which the filling member 1 loaded with the stick-shaped material M is assembled in the main body side assembly 40, or the structure in which the stick-shaped material M is loaded in the filling member 1 assembled in the main body side assembly 40, it is possible to safely protect the stick-shaped material in the filling member 1, even if the stick-shaped material is constituted by a soft semisolid stick-shaped material, an elongated frail stick-shaped material or a soft, jelly-like or mousse-like stick-shaped material.

Further, in this state, the piston 7 is closely attached to the inner peripheral surface of the filling member 1, the stick-shaped material M is closely attached to the inner peripheral surface of the filling member 1, and the piston 7 and the stick-shaped material M are in a closely attached state.

In the stick-shaped material extruding container 100 in the initial state shown in FIG. 1 and structured as mentioned above, when the cap 12 is detached by a user and the filling member 1 and the main body tube 3 are relatively rotated in the feeding out direction, the thread tube 4 synchronously rotating with the main body tube 3 and the movable thread tube 5 are relatively rotated by the rotation stop portion 60 between the rotating member 10 synchronously rotating with the filling member 1 and the movable thread tube 5, and the rotation stop portion 50 between the main body tube 3 and the movable body 6, and the movable thread tube 5 and the movable body 6 are relatively rotated. Accordingly, there is applied an engaging action of the first engagement portion 8 constructed by the engagement projections 5*e* of the movable thread tube 5 and the female thread 4*d* of the thread tube 4, and the second engagement portion 9 constructed by the female thread 5*d* of the movable thread tube 5 and the male thread 6*b* of the movable body 6, the movable thread tube 5 is moved forward, and the movable body 6 is moved forward with respect to the movable thread tube 5. In other words, the movable body 6 is moved forward independently, at the same time of being moved forward together with the movable thread tube 5.

At this time, since the lead of the first engagement portion 8 is set larger than the lead of the second engagement portion 9, the movable thread tube 5 is largely moved forward, and the movable body 6 itself is small moved forward. Accordingly, the movable body 6 is moved forward from the position in the initial state shown in FIG. 1 at an amount obtained by adding a small forward moving amount of the movable body 6 itself to a large forward moving amount of the movable thread tube 5. Further, since the lead of the first engagement portion 8 is set larger than the lead of the second engagement portion 9 as mentioned above, the movable thread tube 5 is quickly moved forward in accordance with the large lead of the first engagement portion 8.

Further, when the movable thread tube 5 is quickly moved forward as mentioned above, the collar portion 5*a* of the movable thread tube 5 is brought into contact with the rear end surface of the spring portion 10*y* of the rotating member 10, the movable thread tube 5 is moved forward and the engagement projections 5*e* of the movable thread tube 5 are detached from the leading end of the female thread 4*d* of the thread tube 4, while the spring 10*y* of the rotating member 10 is compressed so as to store an energizing force in accordance with the relative rotation in the feeding out direction between the filling member 1 and the main body tube 3, whereby the engagement of the first engagement portion 8 is cancelled (refer to FIG. 2).

In this engagement cancelled state, the movable thread tube 5 is energized to the rear side on the basis of the energizing force of the spring portion 10*y* of the rotating member 10. Accordingly, when the relative rotation in the feeding out direction between the filling member 1 and the main body tube 3 is further kept, the engagement projections 5*e* of the movable thread tube 5 energized to the rear side enter to the adjacent leading end in the rotating direction of the female thread 4*d* in the thread tube 4, and the first engagement portion 8 is returned to be engaged. Further, when the relative rotation in the feeding out direction between the filling member 1 and the main body tube 3 is further kept, the movable thread tube 5 is moved forward while the spring portion 10*y* of the rotating member 10 is compressed, and the engagement projections 5*e* of the movable thread tube 5 are detached from the leading end of the female thread 4*d* of the thread tube 4 so as to cancel the engagement. Further, the engagement is returned on the basis of the further relative rotation in the same direction, and the engagement cancel and the engagement return of the first engagement portion 8 are repeated as mentioned above.

In this case, a sliding resistance is generated between the piston 7 installed to the movable body 6 and the inner peripheral surface of the filling member 1, and the sliding resistance becomes a resistance against the energizing force of the spring portion 10*y* applied to the movable body 10 via the second engagement portion 9 at a time of returning the engagement of the first engagement portion 8 on the basis of the energizing force of the spring portion 10*y* of the rotating member 10. In some cases, there is a risk that the first engagement portion 8 is not returned to be engaged on the basis of the energizing force of the spring portion 10*y* of the rotating member 10, however, in the present embodiment, the movable body 6 can be moved at the predetermined amount in the axial direction with respect to the piston 7, as mentioned above.

In other words, when the engagement of the first engagement portion 8 is cancelled and the movable body 6 is energized to the rear side via the second engagement portion 9 on the basis of the energizing force of the spring portion 10*y* of the rotating member 10, the movable body 6 is moved to the rear side with respect to the piston 7 without receiving the sliding resistance between the piston 7 and the inner peripheral surface of the filling member 1, and the first engagement portion 8 is returned to be engaged at the position at which the leading end surface of the annular groove portion 6*d* of the movable body 6 is brought into contact with the root at the leading end side of the annular protruding portion 7*b* of the piston 7. Further, when the movable thread tube 5 is moved forward while the spring portion 10*y* of the rotating member 10 is compressed, on the basis of the further relative rotation in the feeding out direction between the filling member 1 and the main body tube 3, the movable body 6 is moved forward via the second engagement portion 9, and the engagement of the first engagement portion 8 is cancelled. As mentioned above, the movable body 6 moves forward and backward within the predetermined short range (the annular groove portion 6*d* of the movable body 6) in the axial direction with respect to the piston 7 without receiving the sliding resistance between the piston 7 and the inner peripheral surface of the filling member 1, the engagement cancel and the engagement return of the first engagement portion 8 are repeated, and the first engagement portion 8 is smoothly and well returned to be engaged.

Further, in the state in which the movable thread tube 5 is moved forward at the predetermined amount so as to reach the forward moving limit on the basis of the application of the engaging action of the first engagement portion 8, the relative rotation in the feeding out direction between the filling member 1 and the main body tube 3 is kept, and the engagement cancel and the engagement return of the first engagement portion 8 are repeated (in the state in which the engaging action of the first engagement portion 8 does not substantially act), only the engaging action of the second engagement portion 9 is applied, and only the movable body 6 is moved forward, as shown in FIG. 2, on the basis of the cooperation with the rotation stop portion 50. In this case, at a time when only the movable body 6 is moved forward, the movable body 6 is moved forward while coming and going within the predetermined short range in the axial direction, on the basis of the repeat of the engagement cancel and the engagement return of the first engagement portion 8, as mentioned above.

In this case, since the engagement cancel and the engagement return of the first engagement portion 8 are repeated on the basis of the relative rotation in the feeding out direction between the filling member 1 and the main body tube 3, as mentioned above, in the state in which the movable thread tube 5 reaches the forward moving limit and only the movable body 6 is moved forward, a click feeling is accordingly given, and a degree of the relative rotation in the feeding out direction and a moving degree of the movable body 6 are preferably sensed by a user.

Further, only the movable body 6 is moved forward on the basis of the relative rotation accompanying the click feeling in the feeding out direction between the filling member 1 and the main body tube 3, and the stick-shaped material M is pushed out by the piston 7 at the leading end so as to appear through the opening 1*a*.

At this time, since the lead of the second engagement portion 9 is made smaller than the lead of the first engagement portion 8, the movable body 6 is slowly fed out in accordance with the small lead of the second engagement portion 9, and the stick-shaped material M suitably appears from the opening 1*a* of the filling member 1 so as to be set to the used state. In other words, the stick-shaped material M does not erroneously come out too much.

In the case of using from the initial state or the like, specifically, in the case that the leading end surface of the stick-shaped material M exists near the opening 1*a* at the leading end of the filing member 1 and the movable thread tube 5 does not reach the forward moving limit, the stick-shaped material M appears through the opening 1*a* even if the movable thread tube 5 does not reach the forward moving limit.

Further, when the filling member 1 and the main body tube 3 are relatively rotated in the feeding back direction after being used, the engagement projections 5*e* of the movable thread tube 5 energized to the rear side enter into the leading end of the female thread 4*d* of the thread tube 4, and the first engagement portion 8 is returned to be engaged. When the relative rotation in the feeding back direction between the filling member 1 and the main body tube 3 is further kept, the engaging action of the first engagement portion 8 and the second engagement portion 9 is actuated by the rotation stop portion 60 and the rotation stop portion 50, the movable thread tube 5 is moved backward, and the movable body 6 is moved backward with respect to the movable thread tube 5. In other words, the movable body 6 is moved backward independently at the same time of being moved backward together with the movable thread tube 5.

At this time, since the lead of the first engagement portion 8 is made larger than the lead of the second engagement portion 9, the movable threat tube 5 is largely moved backward, and the movable body 6 itself is small moved backward. Accordingly, the movable body 6 is moved backward at an amount obtained by adding the small backward moving amount of the movable body 6 itself to the large backward moving amount of the movable thread tube 5. Further, since the lead of the first engagement portion 8 is set larger than the lead of the second engagement portion 9 as mentioned above, the movable thread tube 5 is quickly moved backward in accordance with the large lead of the first engagement portion 8, and the movable body 6 is quickly moved backward together with the movable thread tube 5.

When the movable thread tube 5 and the movable body 6 are moved backward as mentioned above, since the piston 7 is closely attached to the inner peripheral surface of the filling member 1 as mentioned above, the stick-shaped material M is closely attached to the inner peripheral surface of the filling member 1, and the piston 7 and the stick-shaped material M are closely attached, thereby a sucking action (an action for maintaining the close attachment) generated by decompression is applied to the portion between the piston 7 and the stick-shaped material M in accordance with the backward movement of the piston 7, and the stick-shaped material M is pulled back within the filling member 1 so as to be moved backward, and the stick-shaped material M is retracted from the opening 1*a* at the leading end of the container. Particularly, in the case that the stick-shaped material M is constituted, for example, by a soft, jelly-like or mousse-like stick-shaped material M, the stick-shaped material M tends to be closely attached to the filling member 1 and the piston 7. Accordingly, the sucking action mentioned above better works.

Further, when the movable thread tube 5 is moved backward at the predetermined amount (the movable thread tube 5 is moved backward at the same amount as the forward moving amount) on the basis of the relative rotation in the feeding back direction between the filling member 1 and the main body tube 3, the engagement projections 5*e* of the movable thread tube 5 reaches the rear end of a female thread 4*d* of the thread tube 4, and the collar portion 5*a* of the movable thread tube 5 is brought into contact with an inner peripheral step surface (refer to FIG. 15) between a large-diameter portion 4*x* and a small-diameter portion 4*y* of the thread tube 4 so as to reach the backward moving limit, as shown in FIG. 3, the engaging action of the first engagement portion 8 is stopped and the further relative rotation in the feeding back direction between the filling member 1 and the main body tube 3 is stopped. In other words, it is impossible to relatively rotate the filling member 1 and the main body tube 3 further more in the feeding back direction, and the backward movement of the movable body 6 is stopped. Since the engaging action of the first engagement portion 8 is stopped and the relative rotation is stopped as mentioned above, the rotating force is interfered by the engagement portion 8, and the comparatively thin shaft body 3*y* is not screwed off by torque, even if the large torque is applied on the basis of the further rotation in the feeding back direction.

As mentioned above, the movable body 6 existing at an optional position after being forward moved at a fixed amount or more from the backward moving limit, on the basis of the relative rotation in the feeding back direction between the filling member 1 and the main body tube 3, is not moved backward over the fixed amount. Specifically, the movable body 6 is not moved backward more than an amount obtained by adding the small backward moving amount of the movable body 6 itself at a time when the movable thread tube 5 is moved backward from the forward moving limit to the backward moving limit to the predetermined amount at which the movable thread tube 5 is moved backward from the forward moving limit to the backward moving limit. Accordingly, it is possible to prevent the movable body 6 from being returned too much on the basis of the relative rotation in the feeding back direction between the filling member 1 and the main body tube 3.

Meanwhile, in the case that the movable thread tube 5 existing at the forward moving limit is not moved backward to the backward moving limit on the basis of the relative rotation in the feeding back direction between the filling member 1 and the main body tube 3, for example, specifically even in the operation of moving the movable body 6 backward at a fixed amount or less (within a range which does not reach the fixed amount) without the filling member 1 and the main body tube 3 being relatively rotated to the full extent in the feeding back direction on the basis of the operation of the user, the movable body 6 is moved backward within the range which does not reach the fixed amount and is not returned too much.

When the filling member 1 and the main body tube 3 are again relatively rotated in the feeding out direction by the user in order to set the stick-shaped material M in the use state, from the state in which the movable thread tube 5 and the movable body 6 are fed back and the stick-shaped material M is retracted from the opening 1*a* at the leading end of the container, the engaging action between the first engagement portion 8 and the second engagement portion 9 is actuated by the rotation stop portion 60 and the rotation stop portion 50, in the same manner as mentioned above, the movable thread tube 5 is moved forward, and the movable body 6 is moved forward with respect to the movable thread tube 5.

At this time, the movable thread tube 5 is quickly moved forward in accordance with the large lead of the first engagement portion 8, and the movable body 6 is quickly moved forward together with the quick forward movement of the movable threat tube 5. Further, since the excessive return of the movable body 6 is prevented as mentioned above, it is possible to prevent the stick-shaped material M from not quickly appearing from the opening 1*a*. In other words, an improvement of the usability (easiness of use) is achieved. Further, the same motions as mentioned above are executed thereafter, and the motions mentioned above are repeated.

Further, as shown in FIG. 4, when the piston 7 is moved forward to the maximum on the basis of the relative rotation in the feeding out direction between the filling member 1 and the main body tube 3, the stick-shaped material M is almost used up.

As mentioned above, in accordance with the stick-shaped material extruding container 100 of the present embodiment, since the structure is made such that the piston 7 is closely attached within the filling member 1, the stick-shaped material M is closely attached within the filling member 1, and the stick-shaped material M and the piston 7 are closely attached within the filling member 1, the stick-shaped material M is extruded in accordance with the forward movement of the piston 7 so as to appear from the opening 1*a* at the leading end of the container. On the other hand, the sucking action generated by decompression is applied between the piston 7 and the stick-shaped material M in accordance with the backward movement of the piston 7, the stick-shaped material M is pulled back within the filling member 1, and it is accordingly possible to feed out and feed back the stick-shaped material M without trouble.

Further, in the case that the impact, the vibration or the like is applied and the external action is added, a decompressed state is generated and a closely attaching action is applied between the piston 7 and the stick-shaped material M, if they are going to separate from each other. Accordingly, the stick-shaped material M does not separate from the piston 7, and it is possible to prevent the stick-shaped material M from falling off from the container 100.

Further, since the stick-shaped material M is closely attached within the filling member 1 (particularly, the soft stick-shaped material is closely attached within the filling member 1), as mentioned above, the broken portion does not fall away from the filling member 1 even if the stick-shaped material M is broken within the filling member 1, so that it is possible to continuously use the stick-shaped material M. Further, the closely attachment of the stick-shaped material M to the inner wall of the filling member 1 prevents the stick-shaped material M from being fallen off from the container 100.

Further, in accordance with the stick-shaped material extruding container 100 of the present embodiment, it is possible to use the particularly soft stick-shaped material such as the jelly-like or mousse-like stick-shaped material which can not be maintained as the normal stick-shaped material.

Further, since the engagement portion of the stick-shaped material extruding container 100 is constructed as the double spiral structure constituted by the first and second engagement portions 8 and 9, it is possible to secure the length of the stick-shaped material while saving the length in the axial direction of the container 100, and the movable body 6 can be quickly moved forward on the basis of the cooperation of the first and second engagement portions 8 and 9, and can be slowly moved forward on the basis of the engaging action generated only by the second engagement portion 9 after being moved forward at the predetermined amount, as mentioned above. Accordingly, it is possible to prevent the stick-shaped material M from being erroneously fed out too much.

In this case, when the inner peripheral surface of the filling member 1 is formed in the shape (the taper shape) which is tapered little by little toward the leading end side, it is possible to hold the particularly soft stick-shaped material, and it is possible to further prevent the stick-shaped material M from falling away in the case that the external action such as the impact, the vibration or the like is added at a time of storing so as to safely hold the stick-shaped material M. Accordingly, this structure is preferable.

In this connection, the structure is made such that the movable body 6 accompanied with the movable thread tube 5 is quickly moved forward and backward, and the stick-shaped material M appears suitably slowly by the forward movement of only the movable body 6, by making the lead of the first engagement portion 8 larger than the lead of the second engagement portion 9 as mentioned above. However, it is possible to make the lead of the first engagement portion 8 identical with the lead of the second engagement portion 9, and it is possible to make the lead of the first engagement portion 8 smaller than the lead of the second engagement portion 9.

FIG. 19 is a longitudinal sectional view showing a stick-shaped material extruding container in accordance with a second embodiment of the present invention, FIG. 20 is a longitudinal sectional view at a time when a movable body is moved forward from a state shown in FIG. 19 on the basis of an operation of a user, and FIG. 21 is a longitudinal sectional view at a time when the movable body is moved backward from the state shown in FIG. 20 on the basis of an operation of the user.

As shown in FIG. 19, a stick-shaped material extruding container 500 is provided with a main body tube (a main body) 401 forming a rear half portion of the container, and a filling member 402 forming a front half portion of the container and installed to the main body tube 401 so as to be relatively rotatable and undetachable in an axial direction as an outer shape structure. A container front portion is constructed by the filling member 402 and a container rear portion is constructed by the main body tube 401.

Further, the stick-shaped material extruding container 500 is approximately provided in an inner portion thereof with a stick-shaped material M loaded within the filling member 400 in the same manner as the first embodiment, a rotation stop member 403 inserted into the main body tube 401 so as to construct a rotation stop portion (a rotation stop mechanism) and coupled to the main body tube 401 so as to be synchronously rotatable and undetachable in the axial direction, a thread tube 404 coupled to a rear end portion of the filling member 402 so as to be synchronously rotatable and undetachable in the axial direction, a movable body 406 engaging with the rotating stop member 403 so as to be synchronously rotatable and movable in the axial direction and engaging with the thread tube 404 via an engagement portion 405, and a piston (a piston-like extruding portion) 407 positioned at a leading end of the movable body 406 and inserted into a rear end portion of the filling member 402.

Further, in this stick-shaped material extruding container 500, the movable body 406 is formed in such a shape that two flat surface portions are provided in an opposing manner on an outer peripheral surface extending over a whole length of a columnar shape and is structured such as to have a male thread 406*a* on opposing circular arc shaped outer peripheral surfaces between the two flat surface portions, the engagement portion 405 is structured by a male thread 406*a* on an outer periphery of the movable body 406 and a female thread 404*a* provided on an inner peripheral surface of the thread tube 404, and the rotation stop portion is structured by two flat surface portions provided over the whole length of the inner periphery of the rotation stop member 403 and two flat surface portions on the outer periphery of the movable body 406.

Further, in this stick-shaped material extruding container 500, the piston 407 has an O-ring 408 on an outer peripheral surface thereof, and the O-ring 408 is structured such as to be closely attached to the inner peripheral surface of the filling member 402. Accordingly, it is not necessary to make a precision of the inner peripheral surface of the filling member 402 and the outer peripheral surface of the piston 407 high, and it is possible to easily manufacture. Needless to say the O-ring can be applied to the other embodiments.

Further, in accordance with the stick-shaped material extruding container 500 mentioned above, when the main body tube 401 and the filling member 402 are relatively rotated in the feeding out direction, an engaging action of the engagement portion 405 works, the movable body 406 is moved forward as shown in FIG. 20 on the basis of a cooperation with the rotation stop portion, and the stick-shaped material M is pushed out by the piston 407 at the leading end so as to appear through the opening 402*a* at the leading end and be set to a use state.

Further, when the main body tube 401 and the filling member 402 are relatively rotated in the feeding back direction after being used, the engaging action of the engagement portion 405 works, and the movable body 405 is moved backward as shown in FIG. 21 on the basis of the cooperation with the rotation stop portion.

Then, in the same manner as described in the first embodiment, since the structure is made such that the piston 407 (the O-ring 408) is closely attached within the filling member 402, the stick-shaped material M is closely attached within the filling member 402, and the stick-shaped material M and the piston 407 are closely attached within the filling member 402, a sucking action generated by decompression is applied between the stick-shaped material M and the piston 407 at a time when the movable body 406 is moved backward, and the stick-shaped material M is pulled back within the filling member 402 so as to be moved backward and is retracted from the opening 402*a* at the leading end.

Further, when the main body tube 401 and the filling member 402 are again relatively rotated in the feeding out direction by the user for setting the stick-shaped material M to the use state from this state, the same motion mentioned above is performed.

Further, as for an assembling procedure of the stick-shaped material extruding container 500 as mentioned above, a main body side assembly is obtained by setting (incorporating) the engagement portion 405, an extruding mechanism provided with the rotation stop portion, the thread tube 404, and the movable body 406 having the piston 407 within a main body side tube body constituted by the main body tube 401 and the rotation stop member 403. On the other hand, the filling member 402 is set to a state in which no space exists within the leading end of the filling member 402 after a predetermined amount of molten stick-shaped material is discharged into an inner portion from a nozzle so as to be loaded partway to the rear end from the leading end of the filling member 402 in a state in which the opening 402*a* at the leading end is closed by a seal member and the filling member 402 is inverted, the leading end side of the main body side assembly is fitted from an upper side onto the filling member 402 in which the stick-shaped material M is loaded when if the molten stick-shaped material is cooled and solidified so as to form the stick-shaped material M, and the filling member 402 is installed to the main body tube 401 and the thread tube 404 while the piston 407 is inserted to the filling member 402. At this time, the filling member 402 is engaged with the main body tube 401 and the thread tube 404 while the inner peripheral surface thereof comes into slidable contact with the O-ring 408 for securing an airtightness of the piston 407.

Further, in the same manner as described in FIG. 18 of the first embodiment, it is possible to fill the molten stick-shaped material in the filling member 402 after installing the filling member 402 to the main body side assembly.

In accordance with the stick-shaped material extruding container 500 mentioned above, it is possible to obtain the approximately same effect (except the effect obtained by the double spiral structure, and the effect that the forward moved movable body existing at an optional position is moved backward at the fixed amount and stopped) as the first embodiment.

FIG. 22 is a longitudinal sectional view showing a stick-shaped material extruding container in accordance with a third embodiment of the present invention. As shown in FIG. 22, a stick-shaped material extruding container 200 is provided with a filling member 101, a main body tube (a main body) 102 in which a rear half portion of the filling member 101 is inserted into a front half portion thereof to couple the filling member 101 so as to be synchronously rotatable and undetachable in an axial direction, and an operating tube (an operating body) 103 coupled to a rear end portion of the main body tube 102 so as to be relatively rotatable and undetachable in the axial direction, as an outer shape structure. A container front portion is constructed by the filling member 101 and the main body tube 102, and a container rear portion is constructed by the operating tube 103.

Further, the stick-shaped material extruding container 200 is approximately provided in an inner portion thereof with a stick-shaped material M loaded within the filling member 101 in the same manner as the first embodiment, a thread tube 104 coupled to the operating tube 103 so as to be synchronously rotatable and undetachable in the axial direction, a movable thread tube 105 engaging with the main body tube 102 so as to be synchronously rotatable and movable in the axial direction and engaging with the thread tube 104 via a first engagement portion 108, a movable body 106 engaging with the operating tube 103 so as to be synchronously rotatable and movable in the axial direction and engaging with the movable thread tube 105 via a second engagement portion 109, and a piston (a piston-like extruding portion) 107 installed to a leading end of the movable body 106 and inserted into a rear end portion of the filling member 101.

In accordance with the stick-shaped material extruding container 200, when the main body tube 102 (or the filling member 101) and the operating tube 103 are relatively rotated in the feeding out direction, there is applied an engaging action of the first engagement portion 108 constituted by engagement projections 105*e* of the movable thread tube 5 and a female thread 104*d* of the thread tube 104, and the movable thread tube 105 is moved forward on the basis of a cooperation with a rotation stop portion 160 of the movable thread tube 105 constructed by a rear half portion of a knurling 102*a* of the main body tube 102 and a protrusion 105*c* of the movable thread tube 105. At the same time, there is applied an engaging action of the second engagement portion 109 constructed by a female thread 105*d* of the movable thread tube 105 and a male thread 106*b* of the movable body 106, and the movable body 106 is moved forward on the basis of a cooperation with a rotation stop portion 150 of the movable body 106 constructed by protrusions 103*g* of a shaft body 103*y* of the operating tube 103 and protrusions 106*f* of the movable body 106. In other words, the movable body 106 is moved forward independently at the same time of being moved forward together with the movable thread tube 105, and is quickly moved forward.

Further, when the movable thread tube 105 is moved forward as mentioned above, the leading end surface of the spring portion 105*b* of the movable thread tube 105 is brought into contact with the rear end surface of the filling member 101, the main body portion 105*a* of the movable thread tube 105 is moved forward and the engagement projections 105*e* of the movable thread tube 105 is detached from the leading end of the female thread 104*d* of the thread tube 104 while a compression spring 105*f* of a spring portion 105*b* of the movable thread tube 105 is compressed so as to store energizing force in accordance with a relative rotation in the feeding out direction between the main body tube 102 and the operating tube 103, so that the engagement of the first engagement portion 108 is cancelled.

In the state in which the engagement is cancelled, the main body portion 105*a* of the movable thread tube 105 is energized to the rear side on the basis of the energizing force of the compression spring 105*f* of the movable thread tube 105. Accordingly, when the relative rotation in the feeding out direction between the main body tube 102 and the operating tube 103 is further kept, the engagement projections 105*e* of the main body portion 105*a* of the movable thread tube 105 energized to the rear side enter into the leading end adjacent in the rotating direction of the female thread 104*d* in the thread tube 104, and the first engagement portion 108 is returned to be engaged. Further, when the relative rotation in the feeding out direction between the main body tube 102 and the operating tube 103 is further kept, the main body portion 105*a* of the movable thread tube 105 is moved forward while the compression spring 105*f* of the movable thread tube 105 is compressed, and the engagement projections 105*e* of the movable thread tube 105 are detached from the leading end of the female thread 104*d* of the thread tube 104 so as to cancel the engagement. Further, the engagement is returned by the further relative rotation in the same direction, and the engagement cancel and the engagement return of the first engagement portion 108 mentioned above are repeated.

Further, in the state in which the movable thread tube 105 is moved forward at a predetermined amount so as to reach the forward moving limit on the basis of an application of the engaging action of the first engagement portion 108 as mentioned above, the relative rotation in the feeding out direction between the main body tube 102 and the operating tube 103 is kept, and the engagement cancel and the engagement return of the first engagement portion 108 are repeated (in the state in which the engaging action of the first engagement portion 108 does not substantially work), only the engaging action of the second engagement portion 109 is applied, and only the movable body 106 is slowly moved forward on the basis of a cooperation with the rotation stop portion 150 of the movable body 106.

Thus, only the movable body 106 is moved forward on the basis of the relative rotation in the feeding out direction between the main body tube 102 and the operating tube 103, and the stick-shaped material M is extruded by the piston 107 at the leading end and appears through the opening 101*a* at the leading end so as to be set to a use state. The opening 101*a* is made narrower than a tube hole (a tube hole in the filling member 101) at a rear side thereof, in the present embodiment.

Further, when the main body tube 102 and the operating tube 103 are relatively rotated in the feeding back direction after being used, the engagement projection 105*e* of the movable thread tube 105 energized to the rear side enters into the leading end of the female thread 104*d* of the thread tube 104, and the first engagement portion 108 is returned to be engaged. When the relative rotation in the feeding back direction between the main body tube 102 and the operating tube 103 is further kept, the engaging action of the first engagement portion 108 is operated without trouble, and the movable thread tube 105 is moved backward on the basis of a cooperation with the rotation stop portion 160 of the movable thread tube 105. At the same time, the engaging action of the second engagement portion 109 is operated, and the movable body 106 is moved backward on the basis of a cooperation with the rotation stop portion 150 of the movable body 106. In other words, the movable body 106 is moved backward independently at the same time of being moved backward together with the movable thread tube 105, and is quickly moved backward.

Then, in the same manner as described in the first embodiment, since the structure is made such that the piston 107 is closely attached within the filling member 101, the stick-shaped material M is closely attached within the filling member 101, and the stick-shaped material M and the piston 107 are closely attached within the filling member 101, a sucking action generated by decompression is applied between the stick-shaped material M and the piston 107, at a time when the movable body 106 is moved backward, and the stick-shaped material M is pulled back so as to be moved backward within the filling member 101.

Further, when the movable thread tube 105 is moved backward at a predetermined amount (the movable thread tube 105 is moved backward at the same amount as the forward moving amount), and the engagement projection 105*e* of the movable thread tube 105 reaches the rear end of the female thread 104*d* of the thread tube 104 so as to reach the backward moving limit, on the basis of the relative rotation in the feeding back direction between the main body tube 102 and the operating tube 103, the engaging action of the first engagement portion 108 is stopped and the further relative rotation in the feeding back direction between the main body tube 102 and the operating tube 103 is stopped. In other words, it is impossible to relatively rotate the main body tube 102 and the operating tube 103 any more in the feeding back direction, and the backward movement of the movable body 106 is stopped.

As mentioned above, the movable body 106 existing at an optional position after being moved forward at the fixed amount or more from the backward moving limit is not moved backward more than the fixed amount, on the basis of the relative rotation in the feeding back direction between the main body tube 102 and the operating tube 103. Specifically, the movable body 106 is not moved backward more than the amount obtained by adding the small backward moving amount of the movable body 106 itself at a time when the movable thread tube 105 is moved backward from the forward moving limit to the backward moving limit to the predetermined amount at which the movable thread tube 105 is moved backward from the forward moving limit to the backward moving limit. Accordingly, the movable body 106 is prevented from being returned too much on the basis of the relative rotation in the feeding back direction between the main body tube 102 and the operating tube 103.

Further, if the main body tube 102 and the operating tube 103 are again relatively rotated in the feeding out direction by the user for the purpose of setting the stick-shaped material M from this state to the use state, the same motion as mentioned above is performed.

Meanwhile, in the present embodiment, an O-ring 115 for preventing a rattle in a diametrical direction as well as applying an improved sliding rotation resistance between the main body tube 102 and the operating tube 103 is arranged between the main body tube 102 and the operating tube 103.

Further, as for an assembling procedure of the stick-shaped material extruding container 200 as mentioned above, a main body side assembly is obtained by setting (incorporating) the first and second engagement portions 108 and 109, an extruding mechanism provided with the rotation stop portions 150 and 160, the thread tube 104, the movable thread tube 105, the movable body 106 and the piston 107 within a main body side tube body constituted by the main body tube 102 and the operating tube 103. On the other hand, and the filling member 101 is set to a state in which no space exists within the leading end of the filling member 101 after a predetermined amount of molten stick-shaped material is discharged into an inner portion from a nozzle so as to be loaded in partway to the rear end from the leading end of the filling member 101 in a state in which the opening 101*a* at the leading end is closed by a seal member and the filling member 101 is inverted, the leading end side of the main body side assembly is fitted from an upper side onto the filling member 101 in which the stick-shaped material M is loaded when the molten stick-shaped material is cooled and solidified so as to form the stick-shaped material M, and the filling member 101 is inserted to the main body tube 102 while the piston 107 is inserted to the filling member 101. At this time, the filling member 101 is engaged with the main body tube 102 while the inner peripheral surface thereof comes into slidable contact with the annular protruding portion 107*c* for securing an airtightness of the piston 107.

Further, in the same manner as described in FIG. 18 of the first embodiment, it is possible to fill the molten stick-shaped material in the filling member 101 after installing the filling member 101 to the main body side assembly.

In accordance with the stick-shaped material extruding container 200 mentioned above, it is possible to obtain the approximately same effect as the first embodiment. In addition, since the opening 101*a* at the leading end of the filling member 101 is made narrower than the tube hole (the tube hole of the filling member 101) at the rear side thereof, it is possible to hold particularly a soft stick-shaped material and the stick-shaped material M is further prevented from falling away so as to be safely held in the case that the external action such as the impact, the vibration and the like is applied at a time of being stored. Further, since the once solidified stick-shaped material M is extruded by the piston 107 while being squeezed through the narrow opening 101*a*, a composition is collapsed so as to become soft, and a proper usability can be obtained.

In this case, it is possible to check out a color of the stick-shaped material M through a flange portion 101*z* of the filling member 101 in a state in which the cap is put on the leading end portion, by making the filling member 101 transparent.

FIG. 23 is a longitudinal sectional view showing a stick-shaped material extruding container in accordance with a fourth embodiment of the present invention, and FIG. 24 is an enlarged view of a portion A in FIG. 23. As shown in FIG. 23, a stick-shaped material extruding container 300 is provided with leading tubes 253 forming both leading end sides (right and left end sides in the figure) of the container, and a main body tube (a main body) 251 forming a rear side of the leading tubes 253, as an outer shape structure. Container front portions are constructed by the leading tubes 253, and a container rear portion is constructed by the main body tube 251.

Further, the stick-shaped material extruding container 300 is approximately provided in an inner portion thereof with a coupling members 252 for coupling the leading tubes 253 to the main body tube 251 so as to be relatively rotatable and immovable in the axial direction, rotation stop members 257 constructing rotation stop portions (rotation stop mechanisms), pipe member moving bodies 205 moving forward and backward when the main body tube 251 and the leading tubes 253 are relatively rotated, pipe members (filling members) 254 moving forward and backward in accordance with forward and backward movement of the pipe member moving bodies 205, stick-shaped materials M loaded within the pipe members 254 in the same manner as the embodiments mentioned above, stick-shaped material moving bodies (a movable bodies) 256 which move forward and backward in accordance with forward and backward movement of the pipe member moving bodies 205, move forward when the pipe members 254 reach forward moving limits and the main body tube 251 and the leading tubes 253 are relatively rotated further in the feeding out direction, and move backward when the pipe members 254 reach backward moving limits and the main body tube 251 and the leading tubes 253 are relatively rotated further in the feeding back direction, pistons (piston-like extruding portions) 256*x* installed to leading end portions of the stick-shaped material moving bodies 256 and inserted into rear end portions of the pipe members 254, first engagement portions 258 allowing movement of the pipe member moving bodies 205, and a second engagement portions 259 allowing movement of the stick-shaped material moving bodies 256.

Further, in this stick-shaped material extruding container 300, the first engagement portions 258 are constructed by engagement projections 205*e* of the pipe member moving bodies 205 and spiral grooves 253*i* of the leading tubes 253, the second engagement portions 259 are constructed by female threads 205*j* of the pipe member moving bodies 205 and male threads 256*b* of the stick-shaped material moving bodies 256, and rotation stop portions 270 are constructed by two-flat surface portions 257*e* of the rotation stop members 257 and two-flat surface portions 256*a* of the stick-shaped material moving bodies 256.

Meanwhile, in this embodiment, engaging actions of the first engagement portions 258 work before engaging actions of the second engagement portions 259 by making leads of the first engagement portions 258 larger than leads of the second engagement portions 259. In this connection, for example, operation resistance of the second engagement portions 259 may be lowered in comparison with the first engagement portions 258 by differentiating their materials, thereby making the engaging actions of the first engagement portions 258 work before the engaging actions of the second engagement portions 259.

In the stick-shaped material extruding container 300 mentioned above, in an initial state, as shown in FIGS. 23 and 24, the pipe members 254 and the pipe member moving bodies 205 are in a state of reaching forward moving limits. In this state, when the main body tube 251 and the leading tube 253 are relatively rotated in the feeding out direction, the engaging action of the second engagement portion 259 works because the engaging action of the first engagement portion 258 is in a stop state. Accordingly, the stick-shaped material moving body 256 is slowly fed out on the basis of cooperation with the rotation stop portion 270, and the stick-shaped material M is slowly extruded by the piston 256*x* at the leading end so as to appear from the pipe member 254 and be set in a use state.

Further, when the main body tube 251 and the leading tube 253 are relatively rotated in the feeding back direction after being used, the engaging action of the first engagement portion 258 first works, and the pipe member moving body 205 is quickly moved backward together with the stick-shaped material moving body 256 on the basis of cooperation with the rotation stop portion 270.

Then, in the same manner as described in the first embodiment, since the structure is made such that the piston 256*x* is closely attached within the pipe member 254, the stick-shaped material M is closely attached within the pipe member 254, and the stick-shaped material M and the piston 256*x* are closely attached within the pipe member 254, the piston 256*x* is moved backward together with the pipe member 254 at a time when the stick-shaped material moving body 256 is moved backward, the pipe member 254 is moved backward together with the stick-shaped material M, the leading end portions of the pipe member 254 and the stick-shaped material M are retracted from the opening at the leading end of the leading tube 253, and the pipe member 254 is fed back to an accommodated position within the leading tube 253.

Further, when the rear end surface of the pipe member moving body 205 reaches the backward moving limit at which the rear end surface of the pipe member moving body 205 contacts with the leading end surface of the rotation stop member 257, the engagement projections 205*e* of the pipe member moving body 205 are prevented from being further moved backward, and the engaging action of the first engagement portion 258 is stopped. When the main body tube 251 and the leading tube 253 are relatively rotated in the feeding back direction in this state, the engaging action of the second engagement portion 259 works because the engaging action of the first engagement portion 258 is stopped, whereby the stick-shaped material moving body 256 is slowly moved backward on the basis of cooperation with the rotation stop portion 270. At this time, since the pipe member 254 is prevented by the pipe member moving body 205 from being moved backward any more, and a sucking action generated by decompression is applied between the stick-shaped material M and the piston 256*x*, only the stick-shaped material M is moved backward together with the piston 256*x*, and the leading end portion of the stick-shaped material M is also accommodated within the pipe member 254.

When the main body tube 251 and the leading tube 253 are relatively rotated in the feeding out direction by the user in this state, the engaging action of the first engagement portion 258 works, and the pipe member 254 including the stick-shaped material moving body 256 is quickly moved forward until the engaging action of the first engagement portion 258 is stopped, and the same motions as mentioned above are performed thereafter.

Further, as for an assembling procedure of the stick-shaped material extruding container 300 mentioned above, a main body side assembly is obtained by setting (incorporating) the first and second engagement portions 258 and 259, extruding mechanisms provided with the rotation stop portions 270, the pipe member moving bodies 205, the coupling members 252, the rotation stop members 257, the stick-shaped material moving bodies 256 and the pistons 256*x* within the main body tube 251. In this state, the pipe member moving bodies 205 exist at forward moving limit positions as shown in FIG. 24. On the other hand, at the leading tube 253 side, predetermined amounts of molten stick-shaped materials are discharged to inner portions from nozzles to be loaded partway to the rear ends from the leading ends of the pipe members 254 and are made in a state in which no space exists within the leading ends of the pipe members 254, in a state in which the openings at the leading end of the pipe member 254 are closed by seal members and the pipe members 254 are inverted, the pipe members 254 in which the stick-shaped materials M are loaded are inserted to the leading tubes 253 so as to be positioned at the forward moving limit after the molten stick-shaped materials are cooled and solidified so as to form the stick-shaped materials M, the leading ends of the main body side assembly are inserted from an upper side to the leading tubes 253 in which the pipe members 254 are accommodated, and the leading tubes 253 are installed to the coupling members 252 installed to the main body tube 251 while the pistons 256*x* are inserted to the pipe members 254. At this time, the leading tubes 253 accommodating the pipe members 254 are engaged with the coupling members 252 while the inner peripheral surfaces of the pipe members 254 come into slidable contact with the outer peripheral surfaces of the pistons 256*x*.

Further, in the same manner as described in FIG. 18 of the first embodiment, the molten stick-shaped materials may be loaded in the pipe members 254 after the leading tubes 253 accommodating the pipe members 254 are installed to the main body side assembly.

In accordance with the stick-shaped material extruding container 300 mentioned above, it is possible to obtain approximately the same effects (except the effect that the forward moved movable body existing at an optional position is moved backward at the fixed amount and stopped) as the first embodiment.

FIG. 25 is a longitudinal sectional view showing an initial state of a stick-shaped material extruding container in accordance with a fifth embodiment of the present invention, and FIG. 26 is a longitudinal sectional view at a time when a movable thread tube and a movable body are moved forward on the basis of an operation of a user from a state shown in FIG. 25. As shown in FIG. 25, a stick-shaped material extruding container 400 is provided with a main body tube (a main body) 301 forming a rear half portion of the container, and a leading tube 303 forming a front half portion of the container and coupled to the main body tube 301 via a leading tube holding member 302 so as to be relatively rotatable as an outer shape structure. A container front portion is constructed by the leading tube 303, and a container rear portion is constructed by the main body tube 301 provided with the leading tube holding member 302.

Further, the stick-shaped material extruding container 400 is approximately provided in an inner portion thereof with a pipe member (a filling member) 304, a stick-shaped material M loaded within the pipe member 304 in the same manner as the first embodiment, a female thread member 305 which is coupled to the pipe member 304 so as to be synchronously rotatable and undetachable in an axial direction and moved forward and backward when the main body tube 301 and the leading tube 303 are relatively rotated, a rotating member 316 which is engaged with the main body tube 301 so as to be synchronously rotatable and movable in the axial direction and moved forward and backward in accordance with the forward and backward movement of the female thread member 305, a movable body 306 which is engaged with the rotating member 316 so as to be synchronously rotatable and movable in the axial direction, moved forward and backward in accordance with the forward and backward movement of the female thread member 305 and moved forward when the pipe member 304 reaches a forward moving limit and the main body tube 301 and the leading tube 303 are relatively rotated further in the same direction, a piston (a piston-like extruding portion) 307 installed to a leading end portion of the movable body 306 and inserted into a rear end portion of the pipe member 304, a first engagement portion 308 allowing movement of the female thread member 305, and a second engagement portion 309 allowing movement of the movable body 306.

In this stick-shaped material extruding container 400, the first engagement portion 308 is constructed by engagement projections 305*e* of the female thread member 305 and engagement grooves 303*b* of the leading tube 303, the second engagement portion 309 is constructed by a female thread 305*j* of the female thread member 305 and a male thread 306*b* of the movable body 306, and a rotation stop portion 350 is constructed by protrusions 306*d* of the movable body 306 and protrusions 316*e* of a shaft body 316*y* of the rotating member 316.

Meanwhile, in this embodiment, operation resistance of the second engagement portion 309 is increased so as to be made higher than operation resistance of the first engagement portion 308 by fastening the female thread member 305 on the basis of elastic force of an O-ring 311 installed onto an outer surface of the female thread member 305, whereby an engaging action of the first engagement portion 308 works before an engaging action of the second engagement portion 309. In this case, it is possible to make the engaging action of the first engagement portion 308 work before the engaging action of the second engagement portion 309 by making a lead of the first engagement portion 308 larger than a lead of the second engagement portion 309.

In accordance with the stick-shaped material extruding container 400, when the main body tube 301 and the leading tube 303 are relatively rotated in the feeding out direction by a user from an initial state shown in FIG. 25, the engaging action of the first engagement portion 308 works, and the movable body 306 and the piston 307 are quickly moved forward together with the female thread member 305 and the pipe member 304 on the basis of cooperation with the rotation stop portion 350, and the leading end portion of the pipe member 304 appears from the opening at the leading end of the leading tube 303.

Further, when the female thread member 305 is moved forward at a predetermined amount, an annular protruding portion 305*k* of the female thread member 305 locks with a convex portion 316*d* of the rotating member 316 in the axial direction. When the main body tube 301 and the leading tube 303 are relatively rotated in the feeding out direction continuously, the female thread member 305 is moved forward together with the rotating member 316 on the basis of locking between the annular protruding portion 305*k* and the convex portion 316*d*, and the pipe member 304 is moved forward to a forward moving limit where the engagement projections 305*e* of the female thread member 305 are positioned at leading ends 303*f* of the engagement grooves 303*b* of the leading tube 303, while a protruding amount of the leading end portion of the pipe member 304 from the leading tube 303 is increased, whereby the engaging action of the first engagement portion 308 is stopped. When the main body tube 301 and the leading tube 308 are relatively rotated in the feeding out direction continuously, the engaging action of the second engagement portion 309 works, the movable body 306 and the piston 307 are slowly moved forward on the basis of cooperation with the rotation stop portion 350, and the stick-shaped material M is extruded by the piston 307 so as to appear from the leading end of the pipe member 304 and be set to the use state.

When the main body tube 301 and the leading tube 303 are relatively rotated in the feeding back direction after being used, the engaging action of the first engagement portion 308 works, the movable body 306 and the piston 307 are quickly moved backward together with the female thread member 305 and the pipe member 304 on the basis of cooperation with the rotation stop portion 350, the leading end portion of the pipe member 304 is retracted from the opening at the leading end of the leading tube 303, the rear end surface of the rotating member 316 is brought into contact with the bottom surface of the main body tube 301, and the female thread member 305 reaches the backward moving limit so as to stop the engaging action of the first engagement portion 308. When the main body tube 301 and the leading tube 303 are relatively rotated in the feeding back direction continuously, the engaging action of the second engagement portion 309 works, and the movable body 306 and the piston 307 are slowly moved backward on the basis of cooperation with the rotation stop portion 350.

Then, in the same manner as described in the first embodiment, since the structure is made such that the piston 307 is closely attached within the pipe member 304, the stick-shaped material M is closely attached within the pipe member 304, and the stick-shaped material M and the piston 307 are closely attached within the pipe member 304, a sucking action generated by decompression is applied between the stick-shaped material M and the piston 307, the stick-shaped material M is pulled back so as to be moved backward within the pipe member 304, and the leading end portion of the stick-shaped material M is accommodated within the leading tube 303 and the pipe member 304.

Further, as for an assembling procedure of the stick-shaped material extruding container 400 mentioned above, a main body side assembly is obtained by setting (incorporating) the first and second engagement portions 308 and 309, an extruding mechanism provided with the rotation stop portion 350, the female thread member 305, the rotating member 316, the movable body 306 and the piston 307 within a main body side tube body constituted by the main body tube 301, the leading tube holding member 302 and the leading tube 303. On the other hand, at the pipe member 304 side, a predetermined amount of molten stick-shaped material is discharged to an inner portion from a nozzle so as to be loaded partway to the rear end from the leading end of the pipe member 304 and is made in a state in which no space exists within the leading end of the pipe member 304, in a state in which the opening in the leading end of the pipe member 304 is closed by a seal member and the pipe member 304 is inverted. When the molten stick-shaped material is cooled and solidified so as to form the stick-shaped material M, the leading end side of the main body side assembly is inserted to the pipe member 304, in which the stick-shaped material M is loaded, from the upper side, and the pipe member 304 is installed to the female thread member 305 while the piston 307 is inserted to the pipe member 304. At this time, the pipe member 304 is engaged with the female thread member 305 while the inner peripheral surface of the pipe member 304 comes into slidable contact with the annular protruding portion 307*c* for securing an airtightness of the piston 107.

Further, in the same manner as described in FIG. 18 of the first embodiment, the molten stick-shaped material may be loaded in the pipe member 304 after the pipe member 304 is installed to the main body side assembly.

In accordance with the stick-shaped material extruding container 400 mentioned above, it is possible to obtain approximately the same effects (except the effect that the forward moved movable body existing at an optional position is moved backward at the fixed amount and stopped) as the first embodiment.

Figure 29:
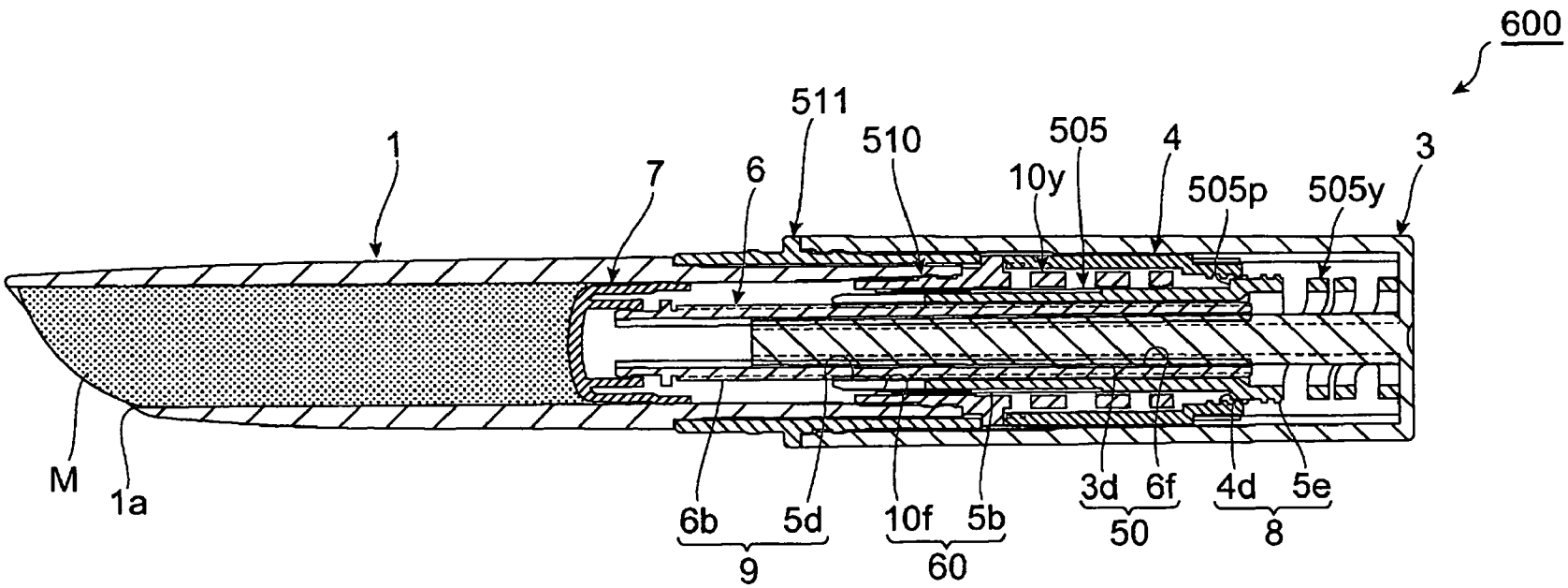
FIG. 29 is a longitudinal sectional view at a time when the movable thread tube and the movable body are moved backward on the basis of an operation of the user after the stick-shaped material is used by the user in the state shown in FIG. 28, and the movable thread tube is moved backward to the backward moving limit.
Figure 30:
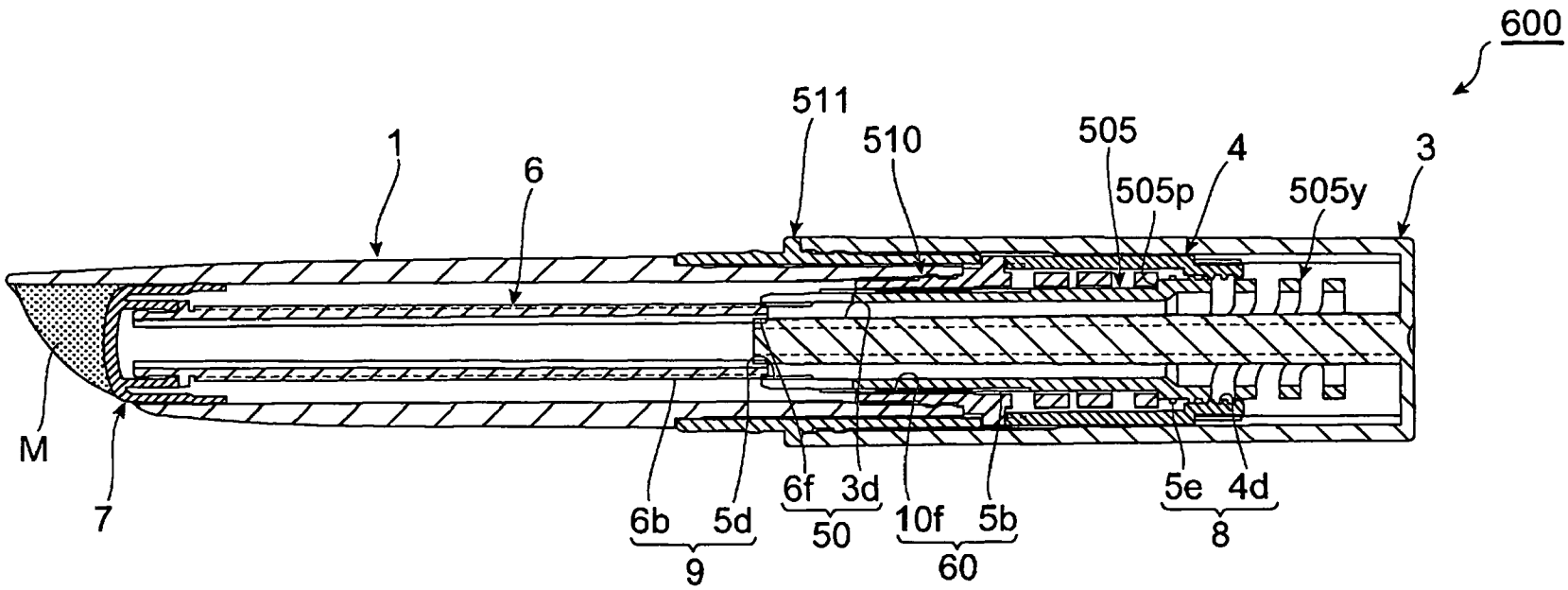
FIG. 30 is a longitudinal sectional view at a time when the movable body is moved forward to the maximum on the basis of an operation of the user from the state shown in FIG. 28.
Figure 31:
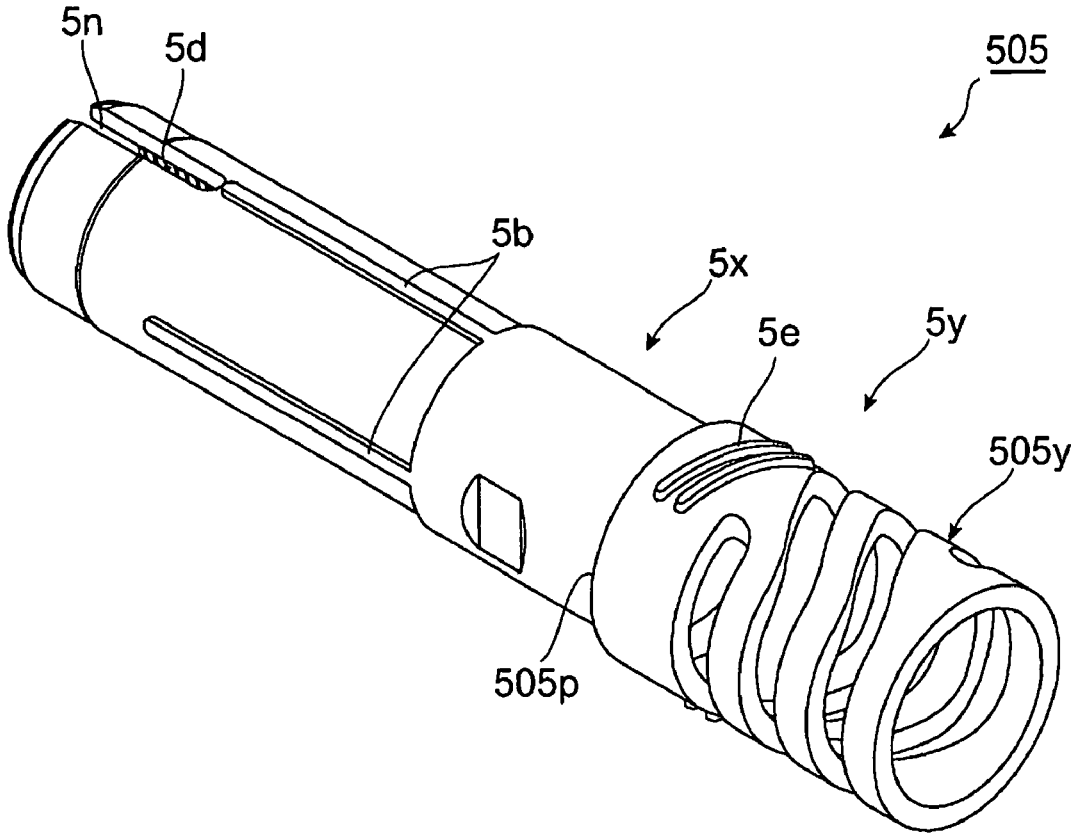
FIG. 31 is a perspective view showing the movable thread tube in FIGS. 27 to 30.
Figure 32:
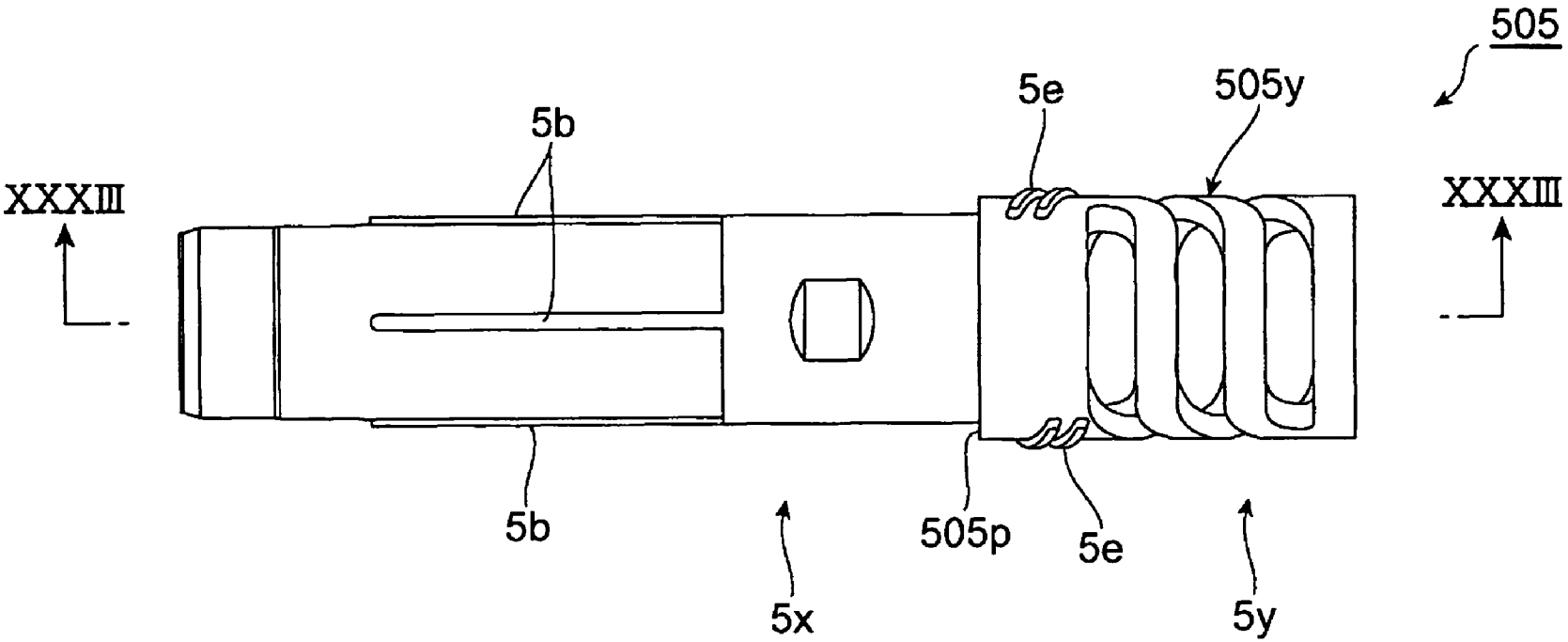
FIG. 32 is a side view of the movable thread tube shown in FIG. 31.
Figure 33:
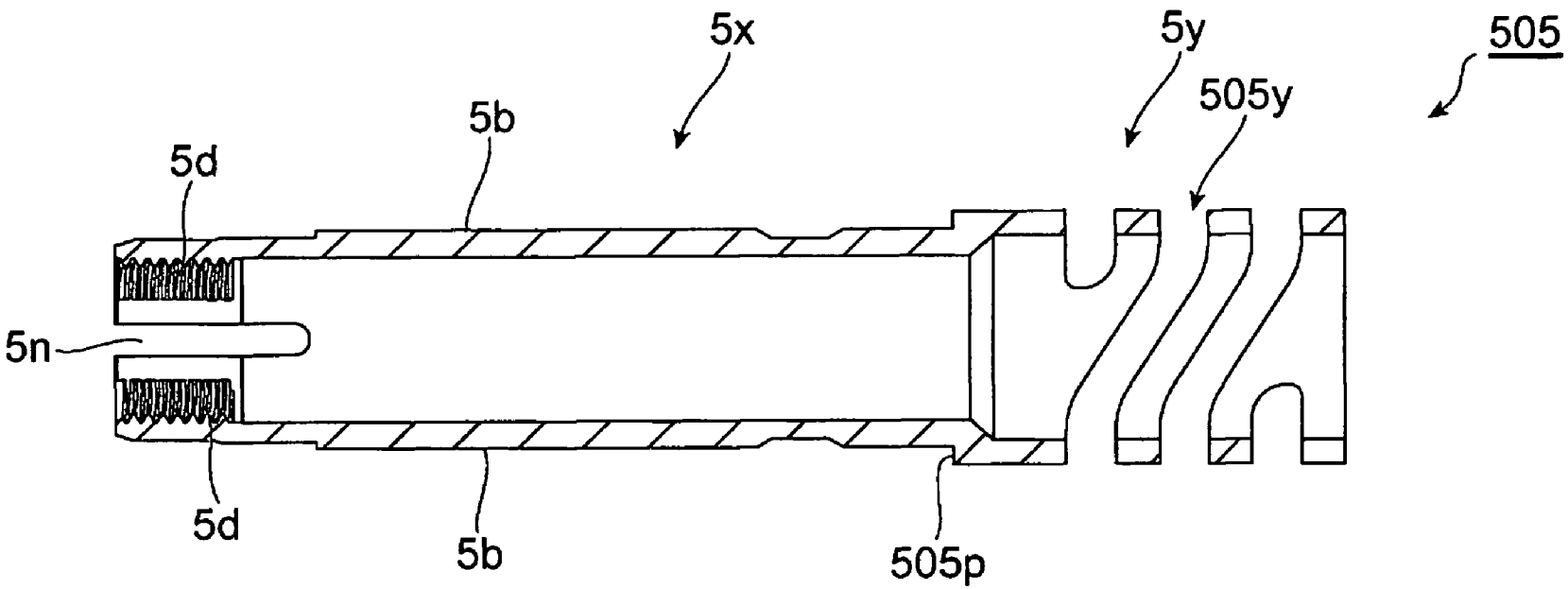
FIG. 33 is a view of a section along a line XXXIII-XXXIII in FIG. 32.

FIGS. 27 to 30 are respective longitudinal sectional views showing respective states of a stick-shaped material extruding container in accordance with a sixth embodiment of the present invention, and FIGS. 31 to 33 are respective views showing a movable thread tube.

A stick-shaped material extruding container 600 in accordance with the sixth embodiment is different from the stick-shaped material extruding container 100 in accordance with the first embodiment in a point that a movable thread tube 505 shown in FIGS. 31 to 33 is used in place of the movable thread tube 5. Further, an intermediate member 511 in which the shape of the intermediate member 11 is somewhat modified is employed in place of the intermediate member 11, and a rotating member 510 in which the shape of the rotating member 10 is somewhat modified is employed in place of the rotating member 10.

As shown in FIGS. 31 to 33, the movable thread tube 505 is different from the movable thread tube 5 shown in FIGS. 10 and 11 in a point that the collar portion 5*a* forming the backward moving limit is omitted, the engagement projections 5*e* are positioned at a front side in comparison with the case of the movable thread tube 5, a step surface 505*p* is provided near the front side of the engagement projections 5*e*, and a front side and a rear side of the step surface 505*p* are respectively formed as the outer diameter small-diameter portion 5*x* and the outer diameter large-diameter portion 5*y*. The step surface 505*p* is brought into contact with a rear end surface of the spring portion 10*y* of a rotating member 510 in place of the collar portion 5*a*. Further, in the movable thread tube 505, a spring portion 505*y* corresponding to a so-called resin spring which is extendable and contractable in the axial direction is integrally provided continuously at a rear side of the engagement projections 5*e*. Further, the other structures are set to the same, and the same reference numerals as those of the movable thread tube 5 are attached to the other same structures. In this case, the long hole 5*c* shown in FIGS. 10 and 11 is omitted therein.

Figure 27:
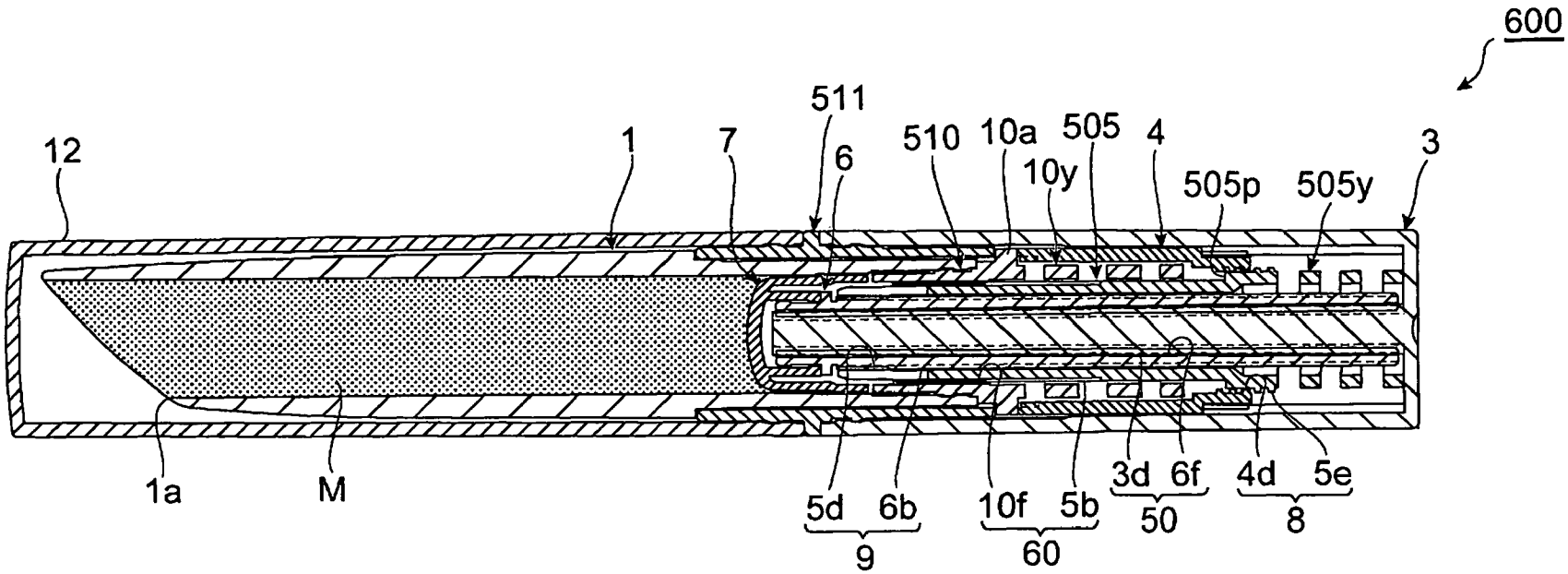
FIG. 27 is a longitudinal sectional view showing an initial state of a stick-shaped material extruding container in accordance with a sixth embodiment of the present invention.

As shown in FIG. 27, the intermediate member 511 is formed in a shape in which the spring portion 11*y* of the intermediate member 11 shown in FIG. 7 is omitted, and the other structures are set to the same.

The rotating member 510 is structured such that the protruding portions 10*b* of the rotating member 10 shown in FIG. 12 are omitted, and the collar portion 10*a* and the spring portion 10*y* are positioned at the front side in comparison with the case of the rotating member 10. Further, the other structures are set to the same, and the same reference numerals as the rotating member 10 are attached to the other same structure. In this case, in accordance with this modification, the structure is made such that the thread tube 4 and the movable thread tube 505 are also positioned at the front side in comparison with the first embodiment.

Further, in the stick-shaped material extruding container 600 in the initial state shown in FIG. 27, the movable thread tube 505 is structured such that a rear end surface of the spring portion 505*y* is brought into contact with the bottom surface of the main body tube 3, and the engagement projections 5*e* is energized to the front side so as to be engaged with the rear end of the female thread 4*d* of the thread tube 4, thereby the first engagement portion 8 is structured. Further, the collar portion 10*a* of the rotating member 510 is positioned between the leading end surface of the thread tube 4 and the rear end surface of the intermediate member 511, and is structured such as to be undetachable in the axial direction by the rear end of the intermediate member 511 and be relatively rotatable with respect to the rear end of the intermediate member 511.

In the stick-shaped material extruding container 600 in the initial state shown in FIG. 27 structured as mentioned above, the forward moving motion of the movable body 6 is the same as the first embodiment. In other words, when the filling member 1 and the main body tube 3 are relatively rotated in the feeding out direction, the engaging actions of the first engagement portion 8 and the second engagement portion 9 are operated, the movable thread tube 505 is moved forward, and the movable body 6 is also moved forward with respect to the movable thread tube 505. In other words, the movable body 6 is independently moved forward at the same time of being moved forward together with the movable thread tube 505, and is quickly moved forward.

Figure 28:
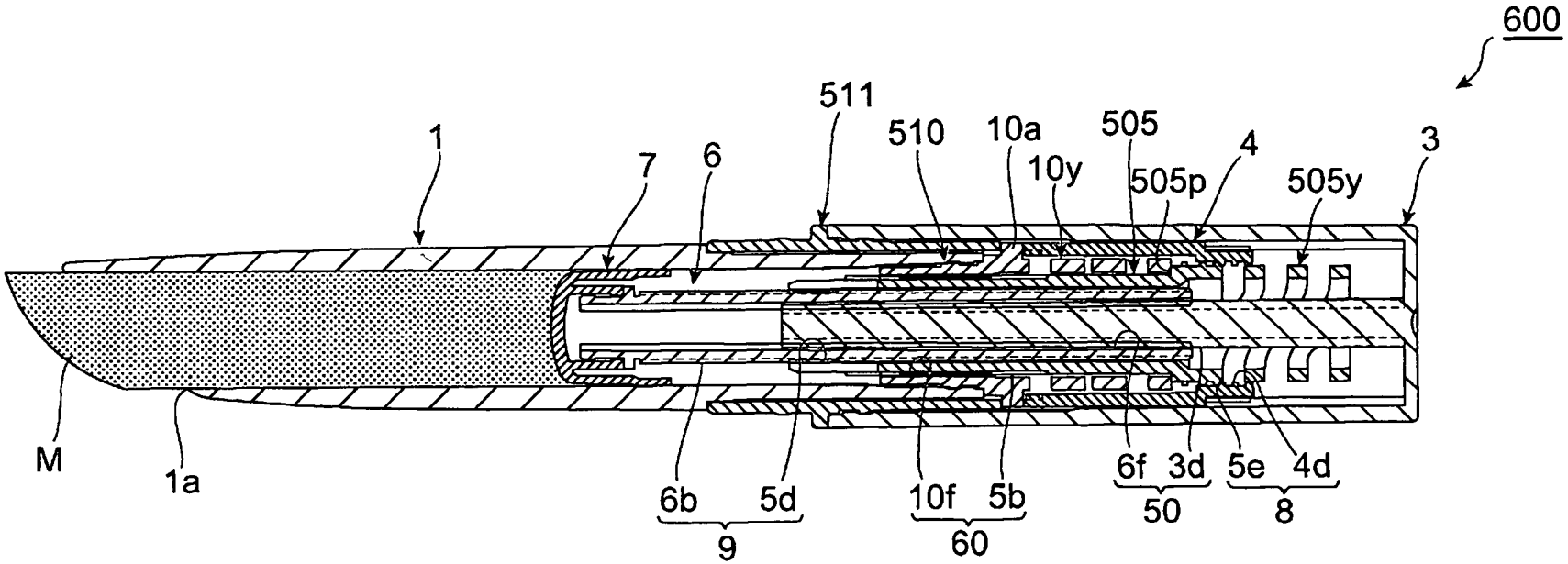
FIG. 28 is a longitudinal sectional view at a time when the cap is detached from the state shown in FIG. 27 and the movable thread tube and the movable body are moved forward on the basis of the an operation of a user.

Further, when the movable thread tube 505 is moved forward at a predetermined amount, and the step surface 505*p* is brought into contact with the rear end surface of the spring portion 10*y* of the rotate member 510, the engagement cancel and the engagement return of the first engagement portion 8 are repeated by the spring portion 10*y*, and the movable body 6 comes and goes within a predetermined short range in the axial direction with respect to the piston 7 without receiving slidable resistance between the piston 7 and the inner peripheral surface of the filling member 1. Further, when they are relatively rotated further in the same direction, only the engaging action of the second engagement portion 9 works in the state in which the engagement cancel and the engagement return of the first engagement portion 8 are repeated, only the movable body 6 is slowly moved forward as shown in FIG. 28, and the stick-shaped material M is extruded by the piston 7 at the leading end so as to slowly appear through the opening 1*a* and be set in a use state.

Further, when the filling member 1 and the main body tube 3 are relatively rotated in the feeding back direction after being used, the first engagement portion 8 is returned to be engaged by the spring portion 10*y* of the rotating member 510, the engaging actions of the first engagement portion 8 and the second engagement portion 9 are operated on the basis of the further relative rotation in the same direction, the movable thread tube 505 is moved backward, and the movable body 6 is also moved backward with respect to the movable thread tube 505. In other words, the movable body 6 is independently moved backward at the same time of being moved backward together with the movable thread tube 505, and is quickly moved backward.

Then, in the same manner as described in the first embodiment, since the piston 7 is closely attached to the inner peripheral surface of the filling member 1, the stick-shaped material M is closely attached within the filling member 1, and the stick-shaped material M and the piston 7 are closely attached within the filling member 1, a sucking action generated by decompression is applied between the stick-shaped material M and the piston 7 at a time when the movable body 6 is moved backward, and the stick-shaped material M is pulled back within the filling member 1 so as to be moved backward.

Further, when the movable thread tube 505 is moved backward on the basis of the further relative rotation in the same direction, as shown in FIG. 29, the rear end surface of the spring portion 505*y* of the movable thread tube 505 is brought into contact with the bottom surface of the main body tube 3 in the same manner as the initial state, and when they are relatively rotated further in the same direction, the movable thread tube 505 is moved backward, the engagement projections 5*e* of the movable thread tube 505 is detached from the leading end of the female thread 4*d* of the thread tube 4 and the engagement of the first engagement portion 8 is cancelled, while the spring portion 505*y* of the movable thread tube 505 is compressed so as to accumulate energizing force.

In the state of the engagement cancel, the movable thread tube 505 is energized to the front side by the energizing force of the spring portion 505*y* of the movable thread tube 505. Accordingly, when the relative rotation in the feeding back direction between the filling member 1 and the main body tube 3 is further kept, the engagement projections 5*e* of the movable thread tube 505 energized to the front side enter into the rear end adjacent in the rotating direction of the female thread 4*d* in the thread tube 4, and the first engagement portion 8 is returned to be engaged. Further, when the relative rotation in the feeding back direction between the filling member 1 and the main body tube 3 is further kept, the movable thread tube 5 is moved backward while the spring portion 505*y* of the movable thread tube 505 is compressed, so that the engagement projections 5*e* of the movable thread tube 505 are detached from the leading end of the female thread 4*d* of the thread tube 4 and the engagement is cancelled. Further, the engagement is returned on the basis of the further relative rotation in the same direction. Such, the engagement cancel and the engagement return of the first engagement portion 8 as mentioned above are repeated.

In this state, the movable body 6 moves forward and backward within the predetermined short range in the axial direction with respect to the piston 7 without receiving slidable resistance between the piston 7 and the inner peripheral surface of the filling member 1, in the same manner as the case of the forward movement. Further, when the relative rotation in the same direction is further kept, only the engaging action of the second engagement portion 9 works in the state in which the engagement cancel and the engagement return of the first engagement portion 8 are repeated, so that only the movable body 6 is slowly moved backward, and can be moved backward to the position in the initial state shown in FIG. 27. Since the movable body 6 is slowly moved backward as mentioned above, it is possible to prevent the stick-shaped material M from being returned too much, and it is possible to thereafter return the stick-shaped material M by fine adjusting.

Further, when the piston 7 is moved forward to the maximum on the basis of the relative rotation in the feeding out direction between the filling member 1 and the main body tube 3, as shown in FIG. 30, the stick-shaped material M is almost used up.

Further, the assembling procedure of the stick-shaped material extruding container 600 mentioned above is the same as the first embodiment.

In accordance with the stick-shaped material extruding container 600 mentioned above, it is possible to obtain approximately the same effect (except the effect that the forward moved movable body 6 existing at an optional position is moved backward at the fixed amount and stopped) as the first embodiment. In addition, the movable body 6 can be quickly moved backward on the basis of the synergic operation of the first engagement portion 8 and the second engagement portion 9, and can be slowly moved backward on the basis of the engaging action generated only by the second engagement portion 9 after being moved backward at the predetermined amount.

The description is specifically given above of the present invention on the basis of the embodiments, however, the present invention is not limited to the embodiments mentioned above, the male thread and the female thread may be those which operate in the same manner as thread ridges, such as a projection group arranged intermittently, or a projection group arranged spirally and intermittently, and the engagement projections may be constituted by continuous thread ridges. Further, it is possible to keep the stick-shaped material in which a volatile component is blended, by applying airtightness to the fitting portion of the cap.

What is claimed is:

1. A stick-shaped material extruding container comprising:

a main body tube having a closed-end cylindrical shape;

a tubular filling member installed to the main body tube and having both ends open;

said main body tube and said filling member being connected so as to be relatively rotatable and undetachable in an axial direction, a stick-shaped material loaded within the filling member so as to be closely attached on the filling member;

a movable body arranged within the main body tube so as to be synchronously rotatable and movable in the axial direction; and a piston-like extruding portion provided within the filling member, and positioned at a leading end of said movable body, wherein the piston-like extruding member slides within said filling member;

wherein when said filling member and main body tube are relatively rotated in one direction, the movable body moves said stick-shaped material forward to an opening at a leading end of the filling member, and when said filling member and main body tube are relatively rotated in the other direction corresponding to an opposite direction to said one direction, said movable body moves rearward towards the closed end, wherein a first engagement portion and a second engagement portion are provided within said main body tube, wherein engaging actions of said first engagement portion and said second engagement portion work together and said movable body is moved forward, when said filling member and main body tube are relatively rotated in said one direction, and the engagement of the first engagement portion is cancelled when the engaging action of said first engagement portion works at a predetermined amount, wherein only the engaging action of said second engagement portion works and the movable body is moved forward, when said filling member and main body tube are relatively rotated further in said one direction, and wherein when said movable body moves backward, a sucking action is applied between the extruding portion and the stick-shaped material on the basis of the backward movement of said extruding portion and said stick-shaped material is pulled back within said filling member, while said extruding portion and said stick-shaped material maintain the closely attached state within said filling member.

2. A stick-shaped material extruding container as claimed in claim 1, wherein said filling member is configured so that said stick-shaped material is preloaded in said filling member.

3. A stick-shaped material extruding container as claimed in claim 1, wherein said main body tube is configured so that said filling member is preinstalled to said main body tube and wherein said filling member is configured so that said stick-shaped material is loaded in said filling member.

4. A stick-shaped material extruding container comprising:

a main body tube having a closed-end cylindrical shape;

a tubular filling member installed to the container and having both ends open;

said main body tube and said filling member being connected so as to be relatively rotatable and undetachable in an axial direction, a stick-shaped material loaded within the filling member so as to be closely attached;

movable body arranged within the main body tube so as to be synchronously rotatable and movable in the axial direction; and a piston-like extruding portion provided within the filling member and positioned at a leading end of said movable body, wherein the piston-like extruding member slides within said filling member;

wherein when said filling member and main body tube are relatively rotated in one direction, the movable body moves said stick-shaped material forward to an opening at a leading end of the filling member, and when said filling member and main body tube are relatively rotated in the other direction corresponding to an opposite direction to said one direction, said movable body moves rearward towards the closed end, wherein a first engagement portion and a second engagement portion are provided within said main body tube, wherein engaging actions of said first engagement portion and said second engagement portion work together and said movable body is moved backward, when said filling member and main body tube are relatively rotated in said other direction, and the engagement of the first engagement portion is cancelled, when the engaging action of said first engagement portion works at a predetermined amount, wherein only the engaging action of said second engagement portion works and said the movable body is moved backward, when said filling member and main body tube are relatively rotated further in said other direction, and wherein when said movable body moves backward, a sucking action is applied between the extruding portion and the stick-shaped material on the basis of the backward movement of said extruding portion and said stick-shaped material is pulled back within said filling member, while said extruding portion and said stick-shaped material maintain the closely attached state within said filling member.

5. A stick-shaped material extruding container as claimed in claim 4, wherein said filling member is configured so that said stick-shaped material is preloaded in said filling member.

6. A stick-shaped material extruding container as claimed in claim 4, wherein said main body tube is configured so that said filling member is preinstalled to said main body tube and wherein said filling member is configured so that said stick-shaped material is loaded in said filling member.

* * * * *